US010377144B2

(12) United States Patent
Ueda et al.

(10) Patent No.: US 10,377,144 B2
(45) Date of Patent: Aug. 13, 2019

(54) INK SUPPLY SYSTEM AND INKJET PRINTER

(71) Applicant: Roland DG Corporation, Hamamatsu-shi, Shizuoka (JP)

(72) Inventors: Naoki Ueda, Hamamatsu (JP); Yoshitaka Hatano, Hamamatsu (JP); Kenji Seki, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/831,461

(22) Filed: Dec. 5, 2017

(65) Prior Publication Data

US 2018/0154642 A1 Jun. 7, 2018

(30) Foreign Application Priority Data

Dec. 6, 2016 (JP) ..... 2016-236886

(51) Int. Cl.
*B41J 2/175* (2006.01)
*B41J 2/18* (2006.01)
*B41J 2/19* (2006.01)

(52) U.S. Cl.
CPC ..... *B41J 2/17566* (2013.01); *B41J 2/175* (2013.01); *B41J 2/17509* (2013.01); *B41J 2/17563* (2013.01); *B41J 2/18* (2013.01); *B41J 2/19* (2013.01); *B41J 2202/07* (2013.01)

(58) Field of Classification Search
CPC . B41J 2/17566; B41J 2/18; B41J 2/175; B41J 2/19; B41J 2202/07
See application file for complete search history.

(56) References Cited

U.S. PATENT DOCUMENTS

2005/0073559 A1* 4/2005 Aruga ..... B41J 2/17509 347/85
2014/0125745 A1 5/2014 Igawa
2015/0375520 A1* 12/2015 Arimoto ..... G01L 27/002 347/6

FOREIGN PATENT DOCUMENTS

JP 2014-094460 A 5/2014

OTHER PUBLICATIONS

Ueda et al., "Air Trap Unit, Ink Supply System, and Inkjet Printer," U.S. Appl. No. 15/831,463, filed Dec. 5, 2017.

* cited by examiner

*Primary Examiner* — Geoffrey S Mruk
(74) *Attorney, Agent, or Firm* — Keating & Bennett, LLP

(57) ABSTRACT

In an ink supply system, an ink tank is connected with an inlet flow channel that is connected with a connection flow channel that is connected with an upstream flow channel, and the upstream flow channel is connected with an ink head. The ink head and the connection flow channel are connected with each other by a downstream flow channel. An upstream pump and an upstream damper are provided in the upstream flow channel, and a downstream pump and a downstream damper are provided in the downstream flow channel. A controller controls the upstream pump and the downstream pump.

10 Claims, 16 Drawing Sheets

INK SUPPLY SYSTEM AND INKJET PRINTER

CROSS REFERENCE TO RELATED APPLICATION

This application claims the benefit of priority to Japanese Patent Application No. 2016-236886 filed on Dec. 6, 2016. The entire contents of this application are hereby incorporated herein by reference.

BACKGROUND OF THE INVENTION

1. Field of the Invention

The present invention relates to an ink supply system and an inkjet printer including the ink supply system.

2. Description of the Related Art

For example, Japanese Laid-Open Patent Publication No. 2014-94460 discloses an inkjet printer including an ink head that includes a nozzle through which ink is ejected, and an ink tank storing the ink to be supplied to the ink head. In this type of inkjet printer, ink is ejected from the nozzle of the ink head toward a recording medium to perform printing on the recording medium.

In the inkjet printer disclosed in Japanese Laid-Open Patent Publication No. 2014-94460, the ink head and the ink tank are connected to each other via a usual flow channel. In the usual flow channel, a damper device supplying ink, supplied from the ink tank, to the ink head while suppressing a pressure change thereof, and a feed pump are provided. The damper device has a discharge opening formed therein, and 1 q a circulation flow channel is connected with the discharge opening and the usual flow channel. As can be seen, in the inkjet printer disclosed in Japanese Laid-Open Patent Publication No. 2014-94460, ink circulates in the flow channel between the ink tank and the ink head.

An example of inkjet printer may be a printer in which ink is circulated in a channel including an ink head, namely, a printer in which a circulation flow channel is connected with an ink head and a usual flow channel. In the case where the feed pump, the damper device, or any other component included in the inkjet printer disclosed in Japanese Laid-Open Patent Publication No. 2014-94460 is used in an inkjet printer in which ink is circulated in the channel including the ink head, the ink may not be properly supplied to the ink head.

SUMMARY OF THE INVENTION

Preferred embodiments of the present invention provide ink supply systems that supply ink properly to an ink head in an inkjet printer circulating the ink from the ink head, and inkjet printers each including such an ink supply system.

An ink supply system according to a preferred embodiment of the present invention includes an ink tank, an ink head, an inlet flow channel, an upstream flow channel, a connection flow channel, a downstream flow channel, an upstream pump, a downstream pump, an upstream damper, a downstream damper, and a controller. The ink tank stores ink. The ink head ejects the ink toward a recording medium. The inlet flow channel includes an end connected with the ink tank. The upstream flow channel is connected with the ink head and allows the ink to flow into the ink head. The connection flow channel connects the inlet flow channel and the upstream flow channel to each other. The downstream flow channel includes an end connected with the ink head and the other end connected with the connection flow channel. The upstream pump is provided in the upstream flow channel and supplies the ink to the ink head. The downstream pump is provided in the downstream flow channel and allows the ink in the ink head to flow out. The upstream damper is provided in the upstream flow channel, at a position closer to the ink head than the upstream pump. The downstream damper is provided in the downstream flow channel, at a position closer to the ink head than the downstream pump. The controller controls the upstream pump and the downstream pump. The upstream damper and the downstream damper each include an ink storage chamber to store the ink, a damper film provided on the ink storage chamber so as to be deformable inward and outward with respect to the ink storage chamber based on an amount of the ink stored in the ink storage chamber, and a spring located in the ink storage chamber to provide the damper film with an elastic force.

According to the above-described ink supply system, the upstream pump and the downstream pump are driven in, for example, a printing state. As a result, the ink stored in the ink tank is supplied to the ink head via the inlet flow channel, the connection flow channel and the upstream flow channel. A portion of the ink in the ink head flows into the downstream flow channel. The ink circulates while flowing in the upstream flow channel, the downstream flow channel, and the connection flow channel. Therefore, the ink is prevented from being kept stored in the ink head. According to the above-described ink supply system, the upstream pump and the upstream damper are provided in the upstream flow channel upstream with respect to the ink head, and the downstream pump and the downstream damper are provided in the downstream flow channel downstream with respect to the ink head. Therefore, based on the flow rate of the ink flowing into the ink storage chamber of the upstream damper and the flow rate of the ink flowing into the ink storage chamber of the downstream damper, the pressure change is significantly reduced or prevented upstream and downstream with respect to the ink head, and thus the driving on the upstream pump and the downstream pump is controlled. For this reason, the pressure in the ink head is easily kept at a negative value, and thus the ink is easily ejected from the ink head properly.

According to preferred embodiments of the present invention, ink is properly supplied to ink heads in inkjet printers.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of ink supply systems and inkjet printers each including an ink supply system according to a preferred embodiment of the present invention will be described with reference to the drawings. The preferred embodiments described below are not intended to specifically limit the present invention, needless to say. Components and portions that have the same functions will bear the same reference signs, and overlapping descriptions will be omitted or simplified optionally.

Figure 1:
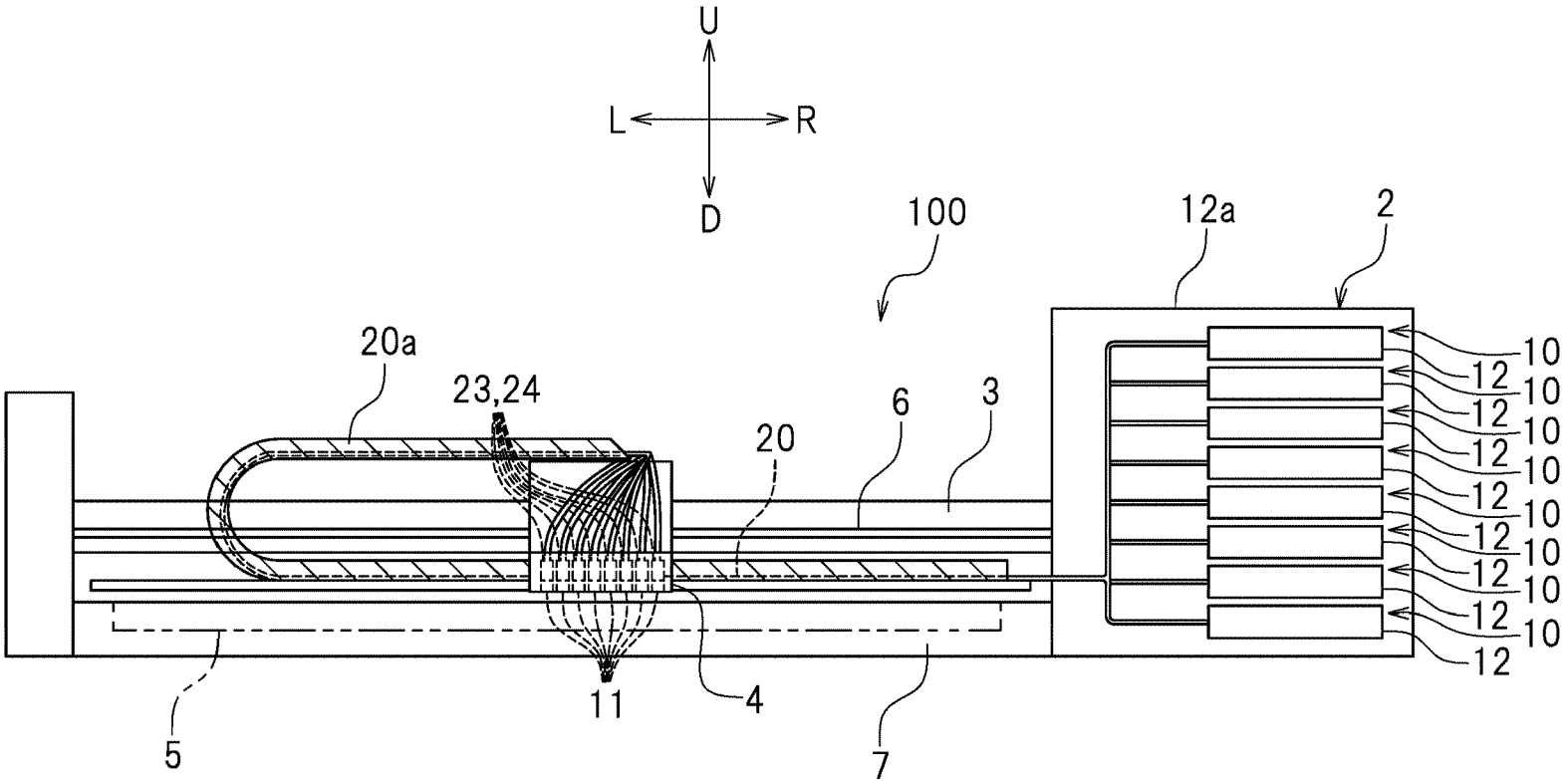
FIG. 1 is a front view showing a printer according to a preferred embodiment of the present invention.

FIG. 1 is a front view of an inkjet printer (hereinafter, referred to as a "printer") 100 according to a preferred embodiment of the present invention. The printer 100 is included in an inkjet system, for example. In this preferred embodiment, the term "inkjet system" refers to an inkjet system using, for example, any of various continuous methods including a binary deflection method, a continuous deflection method and the like, or any of various on-demand methods including a thermal method, a piezoelectric element method and the like. In the following description, letters F, Rr, L, R, U and D respectively represent "front", "rear", "left", "right", "up" and "down" as seen in a front view of the printer 100. These directions are provided merely for the sake of convenience, and do not limit the manner of installation or the like of the printer 100.

As shown in FIG. 1, the printer 100 performs printing on a recording medium 5. In this preferred embodiment, the recording medium 5 is a rolled recording paper sheet, namely, a so-called rolled paper sheet. The recording medium 5 is not limited to being such a rolled recording paper sheet. For example, the recording medium 5 may be a resin sheet. The recording medium 5 is not limited to being a flexible sheet. For example, the recording medium 5 may be a hard medium such as a glass substrate or the like. In this preferred embodiment, there is no specific limitation on the material of the recording medium 5.

In this preferred embodiment, the printer 100 includes a printer main body 2 and a guide rail 3 secured to the printer main body 2. For example, the guide rail 3 extends in a left-right direction. In this example, the guide rail 3 is engaged with a carriage 4. The carriage 4 is slidable along the guide rail 3. Although not shown, a roller is provided at each of a left end and a right end of the guide rail 3. Either one of the rollers is connected with a carriage motor (not shown). The roller connected with the carriage motor is rotatable by the carriage motor. In this example, an endless belt 6 is wound along the rollers respectively provided at both of the two ends of the guide rail 3. The carriage 4 is secured to the belt 6. The carriage motor is driven to rotate the roller, and thus the belt 6 runs. When the belt 6 runs, the carriage 4 is moved in the left-right direction. As can be seen, the carriage 4 is movable in the left-right direction along the guide rail 3.

In this preferred embodiment, the printer main body 2 includes a platen 7, on which the recording medium 5 is to be placed. The platen 7 supports the recording medium 5 when printing is performed on the recording medium 5. The platen 7 includes a grit roller and a pinch roller (neither is shown) as a pair of, namely, top and bottom, rollers. The grit roller is coupled with a feed motor (not shown). The grit roller is driven to rotate by the feed motor. The grit roller rotates in the state where the recording medium 5 is held between the grit roller and the pinch roller, so that the recording medium 5 is transported in a front-rear direction.

In this preferred embodiment, the printer 100 includes a plurality of ink supply systems 10. The ink supply systems 10 each supply ink from an ink tank 12 toward an ink head 11. The ink supply systems 10 also each circulate the ink supplied to the ink head 11. One ink supply system 10 is preferably provided for each ink head 11, for example. In other words, one ink supply system 10 is provided for each ink tank 12. In this preferred embodiment, preferably there are eight ink heads 11, and thus there are eight ink supply systems 10, for example. There is no specific limitation on the number of the ink heads 11, the number of the ink tanks 12, or the number of the ink supply systems 10. The plurality of ink supply systems 10 preferably have the same or substantially the same structure. Thus, one ink supply system 10 will be described in detail below.

Figure 2:
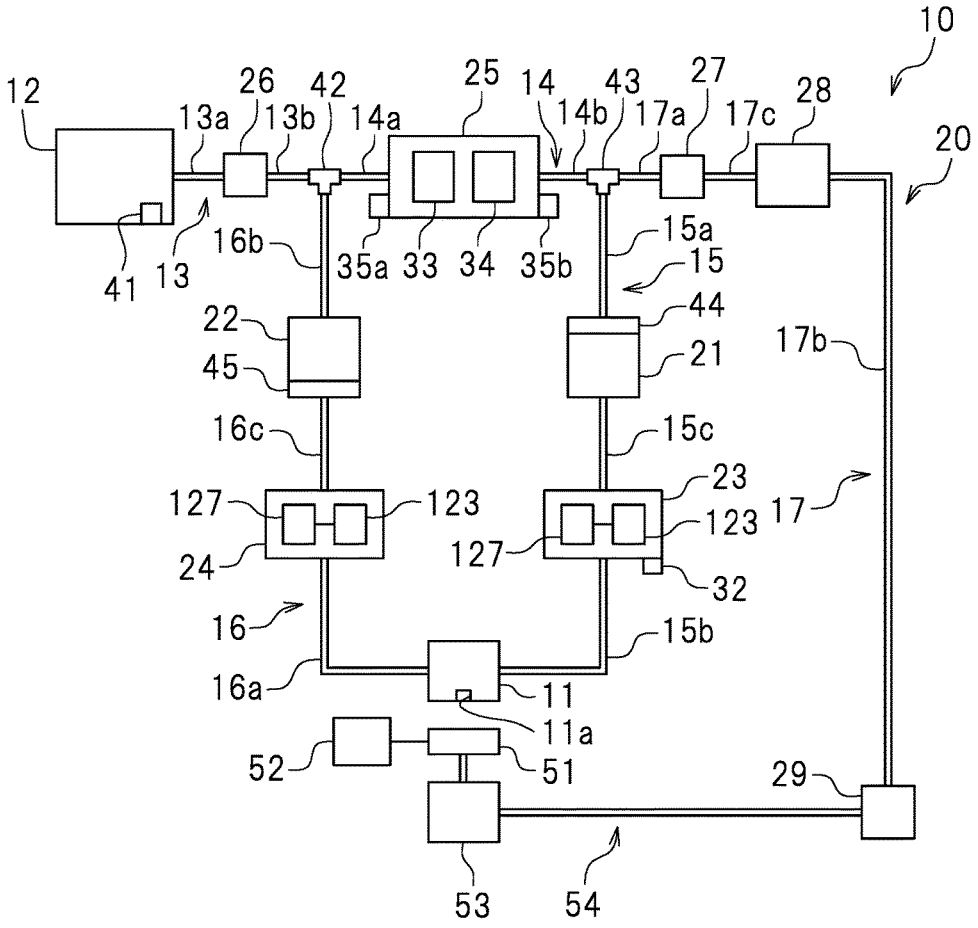
FIG. 2 is a schematic view showing an ink supply system.

FIG. 2 is a schematic view showing the ink supply system 10. As shown in FIG. 2, the ink supply system 10 includes the ink head 11, the ink tank 12, an ink flow channel 20, an upstream pump 21, a downstream pump 22, an upstream damper 23, a downstream damper 24, an air trap 25, an inlet valve 26, an outlet valve 27, and an outlet pump 28. In the following description, the side on which ink flows into the ink head 11 will be referred to as the "upstream side", and the side on which the ink flows out from the ink head 11 will be referred to as the "downstream side".

As shown in FIG. 1, the ink head 11 ejects ink toward the recording medium 5 placed on the platen 7. As shown in FIG. 2, a nozzle 11*a*, from which the ink is ejected, is provided in a bottom surface of the ink head 11. As shown in FIG. 1, the ink head 11 is mounted on the carriage 4. The ink head 11 is movable in the left-right direction via the carriage 4 along the guide rail 3. In more detail, the carriage motor running the belt 6 is driven, so that the ink head 11 is moved in the left-right direction along the carriage 4.

The ink tank 12 stores ink. In this preferred embodiment, the number of the ink tanks 12 preferably is equal to the number of the ink heads 11, for example. In this example, preferably there are eight ink tanks 12. One ink tank 12 is connected with one ink head 11. The ink stored in the ink tank 12 is supplied to the ink head 11. One ink tank 12 stores any one of, for example, process color ink such as cyan ink, magenta ink, yellow ink, light cyan ink, light magenta ink, black ink or the like, and special color ink such as white ink, metallic ink, clear ink or the like. In this preferred embodiment, each two of the eight ink tanks 12 store the same color of ink. For example, the eight ink supply systems 10 are grouped into four groups, namely, a first group, a second group, a third group and a fourth group. Two ink supply systems 10 belong to each group. For example, cyan ink is stored in the ink tanks 12 of the ink supply systems 10 in the first group. Magenta ink is stored in the ink tanks 12 of the ink supply systems 10 in the second group. Yellow ink is stored in the ink tanks 12 of the ink supply systems 10 in the third group. Black ink is stored in the ink tanks 12 of the ink supply systems 10 in the fourth group. It should be noted that the plurality of ink tanks 12 may store different colors of ink. Although not shown, each ink tank 12 includes an ink removal opening (not shown).

There is no specific limitation on the position of each ink tank 12. In this preferred embodiment, the ink tank 12 is detachably provided on the printer main body 12. In more detail, as shown in, for example, FIG. 1, the printer main body 12 includes an accommodation portion 12*a*. The plurality of ink tanks 12 are accommodated in the accommodation portion 12*a*. It should be noted that there is no specific limitation on the position of the ink tanks 12. For example, the ink tanks 12 may be detachably provided on the carriage 4.

As shown in FIG. 2, the ink tank 12 may include a detection sensor 41 to detect the amount of ink stored in the ink tank 12. There is no specific limitation on the type of the detection sensor 41. For example, the detection sensor 41 may be a photointerrupter. For example, the detection sensor 41 detects that the amount of the ink stored in the ink tank 12 is a predetermined amount.

The ink flow channel 20 is usable to supply the ink stored in the ink tank 12 to the ink head 11 and also to circulate the ink in the ink head 11. As shown in FIG. 1, in this preferred embodiment, at least a portion of the ink flow channel 20 is covered with a cable protection and guide device 20*a*. The cable protection and guide device 20*a* is, for example, a cableveyor (registered trademark). As shown in FIG. 2, the ink flow channel 20 includes an inlet flow channel 13, a connection flow channel 14, an upstream flow channel 15, a downstream flow channel 16, and an outlet flow channel 17.

The inlet flow channel 13 is usable to supply the ink stored in the ink tank 12 to the connection flow channel 14. One end of the inlet flow channel 13 is detachably connected with the ink tank 12. The other end of the inlet flow channel 13 is connected with the connection flow channel 14. In this preferred embodiment, the inlet flow channel 13 includes a first inlet portion 13*a* and a second inlet portion 13*b*. The first inlet portion 13*a* includes the one end of the inlet flow channel 13. The first inlet portion 13*a* is detachably connected with the ink tank 12. The first inlet portion 13*a* is structured such that when the ink tank 12 is detached from the one end of the inlet flow channel 13, the ink does not leak from the one end of the inlet flow channel 13. The second inlet portion 13*b* includes the other end of the inlet flow channel 13. The second inlet portion 13*b* is connected with the connection flow channel 14.

The connection flow channel 14 is usable to supply the ink, supplied to the inlet flow channel 13, to the upstream flow channel 15. The connection flow channel 14 connects the inlet flow channel 13 and the upstream flow channel 15 to each other. One end of the connection flow channel 14 is connected with the other end of the inlet flow channel 13. In this preferred embodiment, a three-way valve 42 is provided at the one end of the connection flow channel 14. The one end of the connection flow channel 14 is connected with the other end of the inlet flow channel 13 via the three-way valve 42. The other end of the connection flow channel 14 is connected with the upstream flow channel 15. In this example, the connection flow channel 14 includes a first connection portion 14*a* and a second connection portion 14*b*. The first connection portion 14*a* includes the one end of the connection flow channel 14. The first connection portion 14*a* is connected with the second inlet portion 13*b* via the three-way valve 42. The second connection portion 14*b* includes the other end of the connection flow channel 14. The second connection portion 14*b* is connected with the upstream flow channel 15.

The upstream flow channel 15 allows the ink, supplied to the connection flow channel 14, to be supplied to the ink head 11. One end of the upstream flow channel 15 is connected with the other end of the connection flow channel 14. In this example, a three-way valve 43 is provided at the one end of the upstream flow channel 15. The one end of the upstream flow channel 15 is connected with the other end of the connection flow channel 14 via the three-way valve 43. The other end of the upstream flow channel 15 is connected with the ink head 11. In this preferred embodiment, the upstream flow channel 15 includes a first upstream portion 15*a*, a second upstream portion 15*b* and an upstream middle portion 15*c*. The first upstream portion 15*a* includes the one end of the upstream flow channel 15. The first upstream portion 15*a* is connected with the second connection portion 14*b* via the three-way valve 43. The second upstream portion 15*b* includes the other end of the upstream flow channel 15. The second upstream portion 15*b* is connected with the ink head 11. The upstream middle portion 15*c* is located between the first upstream portion 15*a* and the second upstream portion 15*b*. The upstream middle portion 15*c* is connected with the first upstream portion 15*a* and the second upstream portion 15*b*.

The downstream flow channel 16 is a flow channel from which the ink in the ink head 11 flows out. The downstream flow channel 16 allows the ink in the ink head 11 to flow into the connection flow channel 14. In this example, one end of the downstream flow channel 16 is connected with the ink head 11. The other end of the downstream flow channel 16 is connected with the one end of the connection flow channel 14. In more detail, the other end of the downstream flow channel 16 is connected with the one end of the connection flow channel 14 and the other end of the inlet flow channel 13 via the three-way valve 42. In this preferred embodiment, the downstream flow channel 16 includes a first downstream portion 16*a*, a second downstream portion 16*b* and a downstream middle portion 16*c*. The first downstream portion 16*a* includes the one end of the downstream flow channel 16. The first downstream portion 16*a* is connected with the ink head 11. The second downstream portion 16*b* includes the other end of the downstream flow channel 16. The second downstream portion 16*b* is connected with the second inlet portion 13*b* and the first connection portion 14*a* via the three-way valve 42. The downstream middle portion 16*c* is located between the first downstream portion 16*a* and the second downstream portion 16*b*. The downstream middle portion 16*c* is connected with the first downstream portion 16*a* and the second downstream portion 16*b*.

The outlet flow channel 17 is usable to discharge the ink in the inlet flow channel 13, the connection flow channel 14, the upstream flow channel 15 and the downstream flow channel 16 to outside. One end of the outlet flow channel 17 is connected with the other end of the connection flow channel 14. In more detail, the one end of the outlet flow channel 17 is connected with the other end of the connection flow channel 14 and the one end of the upstream flow channel 15 via the three-way valve 43. In this preferred embodiment, the other end of the outlet flow channel 17 is connected with an exhaust liquid tank 29. The exhaust liquid tank 29 is a tank to which the ink flowing in the ink flow channel 20 or the like of the ink supply system 10 is discharged.

In this preferred embodiment, the outlet flow channel 17 includes a first outlet portion 17*a*, a second outlet portion 17*b* and an outlet middle portion 17*c*. The first outlet portion 17*a* includes the one end of the outlet flow channel 17. The first outlet portion 17*a* is connected with the second connection portion 14*b* and the first upstream portion 15*a* via the three-way valve 43. The second outlet portion 17*b* includes the other end of the outlet flow channel 17. The second outlet portion 17*b* is connected with the exhaust liquid tank 29. The outlet middle portion 17*c* is located between the first outlet portion 17*a* and the second outlet portion 17*b*. The outlet middle portion 17*c* is connected with the first outlet portion 17*a* and the second outlet portion 17*b*.

In this preferred embodiment, the ink flow channel 20 includes a flexible tube. In more detail, the inlet flow channel 13, the connection flow channel 14, the upstream flow channel 15, the downstream flow channel 16 and the outlet flow channel 17 each include, for example, a flexible tube. There is no specific limitation on the type or material of any of the inlet flow channel 13, the connection flow channel 14, the upstream flow channel 15, the downstream flow channel 16 and the outlet flow channel 17.

The upstream pump 21 and the downstream pump 22 are usable to supply the ink. The upstream pump 21 is usable to supply the ink toward the ink head 11, and adjusts the flow rate of the ink to be supplied to the ink head 11. The downstream pump 22 is usable to circulate the ink flowing out of the ink head 11 to supply the ink to the connection flow channel 14. The downstream pump 22 adjusts the flow rate of the ink to be flowed out of the ink head 11. In this preferred embodiment, the upstream pump 21 is provided in the upstream flow channel 15. In more detail, the upstream pump 21 is provided between the first upstream portion 15*a* and the upstream middle portion 15*c*. The downstream pump 22 is provided in the downstream flow channel 16. In more detail, the downstream pump 22 is provided between the downstream middle portion 16*c* and the second downstream portion 16*b*. In this example, the ink head 11 is located between the upstream pump 21 and the downstream pump 22. Therefore, the flow rate of the ink is adjusted by the upstream pump 21, so that the pressure in the flow channel upstream with respect to the ink head 11 (in this example, the upstream flow channel 15) is adjusted, and the pressure in the flow channel downstream with respect to the ink head 11 (in this example, the downstream flow channel 16) is adjusted by the downstream pump 22. The pressure upstream and downstream with respect to the ink head 11 is adjusted in this manner, so that the pressure in the ink head 11 is adjusted. The ink is ejected in accordance with the pressure in the ink head 11.

In this preferred embodiment, the upstream pump 21 and the downstream pump 22 are of the same type. Alternatively, the upstream pump 21 and the downstream pump 22 may be of different types. In this example, the upstream pump 21 and the downstream pump 22 are diaphragm pumps. There is no specific limitation on the type of the upstream pump 21 or the downstream pump 22. Although not shown, the upstream pump 21 and the downstream pump 22 each include an elastically deformable diaphragm and a pump motor elastically deforming the diaphragm. The pump motor is driven to elastically deform the diaphragm, so that the upstream pump 21 and the downstream pump 22 adjust the flow rate of the ink. In this preferred embodiment, the expressions that "the upstream pump 21 is driven" and "the downstream pump 21 is driven" each refer to a state where the pump motor is driven and the diaphragm is elastically deformed.

In this preferred embodiment, for example, the upstream pump 21 includes a flow inlet (not shown) through which the ink flows in. The flow inlet of the upstream pump 21 may be provided with an upstream filter 44 that capture impurities such as sediment or the like in the ink flow channel 20. This prevents an inconvenience that may be caused by entrance of the impurities to the upstream pump 21. Similarly, the downstream pump 22 includes a flow inlet (not shown) through which the ink flows in. The flow inlet of the downstream pump 22 may be provided with a downstream filter 45 that captures impurities in the ink flow channel 20. This prevents an inconvenience that may be caused by entrance of the impurities to the downstream pump 22.

The upstream damper 23 and the downstream damper 24 alleviate a pressure change of the ink to stabilize an ink ejection operation of the ink head 11. The upstream damper 23 detects the flow rate of the ink flowing into the upstream damper 23. Based on the detection results of the flow rate of the ink made by the upstream damper 23, the driving on the upstream pump 21 is controlled. The downstream damper 24 detects the flow rate of the ink flowing into the downstream damper 24. Based on the detection results of the flow rate of the ink made by the downstream damper 24, the driving on the downstream pump 22 is controlled.

In this preferred embodiment, the upstream damper 23 is provided in the upstream flow channel 15. In more detail, the upstream damper 23 is provided in a portion of the upstream flow channel 15 closer to the ink head 11 than the upstream pump 21 is. In this preferred embodiment, the upstream damper 23 is provided between the upstream middle portion 15*c* and the second upstream portion 15*b* of the upstream flow channel 15. The downstream damper 24 is provided in the downstream flow channel 16. In more detail, the downstream damper 24 is provided in a portion of the downstream flow channel 16 closer to the ink head 11 than the downstream pump 22 is. In this preferred embodiment, the downstream damper 24 is provided between the first downstream portion 16*a* and the downstream middle portion 16*c* of the downstream flow channel 16.

In this preferred embodiment, the upstream damper 23 and the downstream damper 24 are preferably made of different materials from each other. In this example, the upstream damper 23 and the downstream damper 24 preferably have the same structure or substantially the same as each other. Thus, the structure of the upstream damper 23 will be described below, and the description on the structure of the downstream damper 24 will be omitted.

Figure 3:
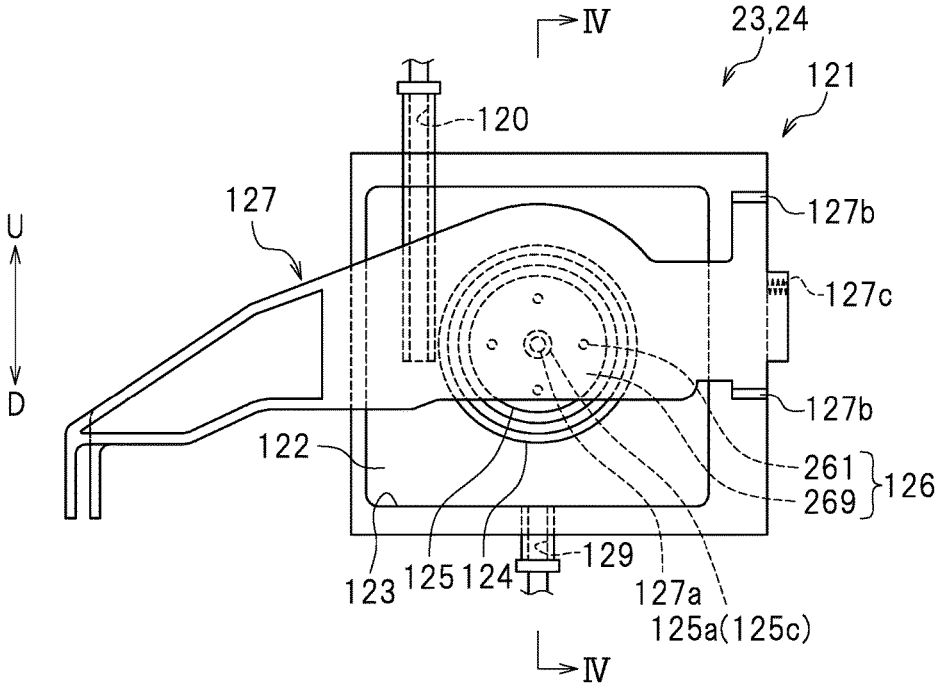
FIG. 3 is a side view of an upstream damper.
Figure 4:
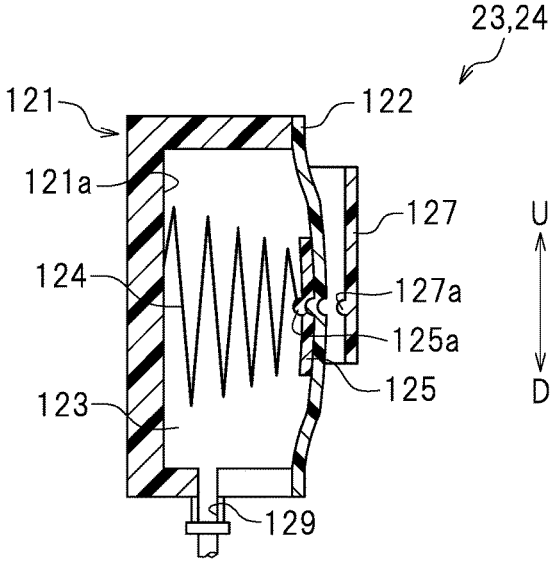
FIG. 4 is a cross-sectional view of the upstream damper taken along line IV-IV in FIG. 3

FIG. 3 is a side view of the upstream damper 23. FIG. 4 is a cross-sectional view of the upstream damper 23 taken along line IV-IV in FIG. 3. As shown in FIG. 3, the upstream damper 23 includes a hollow case main body 121 opened at a surface (right surface in FIG. 4) and a damper film 122 attached to an outer wall of the case main body 121 to cover the opening. The case main body 121 is preferably made of a resin. There is no specific limitation on the material of the case main body 121. In this example, as shown in FIG. 4, a region enclosed by the case main body 121 and the damper film 122 is an ink storage chamber 123. A detection lever 127 is located on a surface of the damper film 122 opposite to the ink storage chamber 123. In this preferred embodiment, neither the upstream damper 23 nor the downstream damper 24 has a so-called valve structure.

As shown in FIG. 3, an ink inlet 120 through which the ink flows into the ink storage chamber 123 is provided in a wall of the case main body 121 (top surface in FIG. 3). In this preferred embodiment, the ink inlet 120 of the upstream damper 23 is connected with the upstream middle portion 15*c* (see FIG. 2) of the upstream flow channel 15. The ink inlet 120 is in communication with the ink tank 12. The ink inlet 120 of the downstream damper 24 is connected with the first downstream portion 16*a* (see FIG. 2) of the downstream flow channel 16, and is in communication with the ink tank 12. A tip (bottom end) of the ink inlet 120 is at a level at about half of the height of the ink storage chamber 123. An ink outlet 129 through which the ink flow out of the ink storage chamber 123 is provided in another wall (bottom surface in FIG. 3) of the case main body 121. In this preferred embodiment, the ink outlet 129 of the upstream damper 23 is connected with the second upstream portion 15*b* (see FIG. 2) of the upstream flow channel 15. The ink outlet 129 is in communication with the ink head 11. The ink outlet 129 of the downstream damper 24 is connected with the downstream middle portion 16*c* (see FIG. 2) of the downstream flow channel 16, and is in communication with the ink head 11. The ink inlet 120 and the ink outlet 129 are each in communication with the ink storage chamber 123. In this preferred embodiment, the ink storage chamber 123 preferably is rectangular-parallelepiped, for example. There is no specific limitation on the shape of the ink storage chamber 123. A predetermined amount of ink is temporarily stored in the ink storage chamber 123.

The damper film 122 is bonded to a perimeter of the case main body 121 by, for example, thermal welding at a tensile strength sufficient for the damper film 122 to be warped inward and outward with respect to the ink storage chamber 123. The damper film 122 is structured to be warped and deformed in accordance with the pressure in the ink storage chamber 123. In this example, the damper film 122 is a flexible resin film. The damper film 122 may include a single-layer structure, or a multi-layer structure including a stack of films of different materials that are integrated together. A surface of the damper film 122 on the side of the ink storage chamber 123 may be coated for the purpose of improving the resistance against corrosion by ink.

As shown in FIG. 4, an end of a tapered spring 124 is attached in the ink storage chamber 123, more specifically, attached to a surface 121*a* of the case main body 121 that faces the damper film 122. The other end of the spring 124 is connected with a pressure bearing plate 125. The spring 124 is coupled with the damper film 122. The spring 124 is an example of elastic member pressing the damper film 122 outward with respect to the ink storage chamber 123. The spring 124 is kept in a compressed state. As a result, the damper film 122 is pressed outward with respect to the ink storage chamber 123 (rightward in FIG. 4) and is warped. When the amount of the ink stored in the ink storage chamber 123 is decreased to a predetermined amount and the pressure in the ink storage chamber 123 is decreased to a certain degree, the damper film 122 is warped inward with respect to the ink storage chamber 123 against the spring force (elastic force) of the spring 124.

The spring 124 is conical when not being compressed, and is structured such that an inner diameter thereof gradually changes in a height direction of the conical shape. The spring 124 is contracted in the height direction as being compressed, and becomes like a generally flat plate when being totally compressed. In this preferred embodiment, the spring 124 is located such that the inner diameter thereof is decreased as approaching the damper film 122 from the wall 121*a* of the case main body 121. There is no specific limitation on the material of the spring 124. The spring 124 may be coated for the purpose of improving the resistance against corrosion by ink.

In this preferred embodiment, the pressure bearing plate 125 is located in the ink storage chamber 123, more specifically, between the damper film 122 and the spring 124. The pressure bearing plate 125 is located at substantially the center of the damper film 122 so as to uniformly press the damper film 122 outward with respect to the ink storage chamber 123. In this preferred embodiment, the pressure bearing plate 125 is disc-shaped. The material of the pressure bearing plate 125 may be selected in consideration of the ease of joining with the damper film 122. The pressure bearing plate 125 may be made of a material harder than that of the damper film 122. The pressure bearing plate 125 may be relatively lightweight so as not to inhibit the deformation of the damper film 122. In this preferred embodiment, the pressure bearing plate 125 is preferably made of a polyacetal resin.

In this preferred embodiment, a surface of the pressure bearing plate 125 that faces the damper film 122 has a surface area size of about 10% or greater, typically about 10% to about 30%, for example, about 15% to about 20% of the total surface area size of the damper film 122. In the case where the area size of the surface facing the damper film 122 is large, the pressure bearing plate 125 uniformly presses the damper film 122 outward with respect to the ink storage chamber 123, and also the warping deformation of the damper film 122 is transmitted to the pressure bearing plate 125 with high precision. In the meantime, if the pressure bearing plate 125 attached to the damper film 122 has a large area size, the range in which the damper film 122 is movable may be significantly restricted. Therefore, the pressure bearing plate 125 and the damper film 122 are not joined entirely, but are joined intermittently. With such an arrangement, the pressure bearing area size of the pressure bearing plate 125 is large while the range in which the damper film 122 is movable is kept relatively large. As a result, the damper film 122 is warped and deformed smoothly in accordance with the change in the amount of the ink. Herein, the expression "joined intermittently" refers to that the pressure bearing plate 125 and the damper film 122 are not joined entirely, but a portion of the pressure bearing plate 125 is intentionally left not joined with the damper film 122.

An intermittently joined portion 126 is provided on the surface of the pressure bearing plate 125 that faces the damper film 122. The intermittently joined portion 126 includes joined portions 261 joined with the damper film 122 (in this example, four joined portions 261) and a non-joined portion 269 not joined with the damper film 122. The four joined portions 261 are located on a circumference that is centered around a center 125*c* of the pressure bearing plate 125 and is slightly smaller than the pressure bearing plate 125. There is no specific limitation on the number of the joined portions 261. For example, a plurality of the joined portions 261, for example, two or greater, three or greater, four or greater, or five or greater joined portions 261 may be provided. At least a portion of the non-joined portion 269 is located closer to the center 125*c* of the pressure bearing plate 125 than a portion of the joined portions 261 that is closest to the perimeter of the pressure bearing plate 125. The non-joined portion 269 is not closed by the joined portions 261. Namely, the non-joined portion 269 is opened such that air bubbles do not stay in the intermittently joined portion 126. The area size of the joined portions 261 occupies about 90% or less, typically about 80% or less, for example, about 70% or less, of the total area size of the surface of the pressure bearing plate 125 that faces the damper film 122, for example. The area size of the non-joined portion 269 occupies about 10% or greater, typically about 20% or greater, for example, about 30% or greater, of the total area size of the surface of the pressure bearing plate 125 that faces the damper film 122, for example.

As shown in FIG. 4, the detection lever 127 is located outer to the ink storage chamber 123. The detection lever 127 is an ink storage amount detection device detecting the amount of the ink stored in the ink storage chamber 123 from the warping degree (positional change) of the damper film 122. As shown in FIG. 3, the detection lever 127 is secured to a wall of the case main body 121 by two securing portions 127*b*. The detection lever 127 is coupled with the center 125*c* of the pressure bearing plate 125 via the damper film 122. The detection lever 127 is located so as to be closer to, or spaced from, the damper film 122 by a spring member 127*c*. The detection lever 127 is kept in contact with the damper film 122. The detection lever 127 is displaced based on the deformation of the damper film 122.

For example, when the amount of the ink stored in the ink storage chamber 123 is decreased, the damper film 122 is warped by a predetermined amount inward with respect to the ink storage chamber 123. Along with such warping deformation of the damper film 122, the detection lever 127 is displaced by a predetermined amount toward the ink storage chamber 123. In contrast, when ink is supplied to the ink storage chamber 123 to increase the amount of the ink in the ink storage chamber 123, the damper film 122 is warped outward with respect to the ink storage chamber 123. Along with the warping deformation of the damper film 122, the detection lever 127 is displaced by a predetermined amount away from the ink storage chamber 123. In this manner, it is determined whether or not the amount of the ink stored in the ink storage chamber 123 is within a predetermined range based on the information on the displacement of the detection lever 127. It is determined, for example, whether or not the amount of the ink stored in the ink storage chamber 123 has reached a predetermined lower limit and/or whether or not the amount of the ink stored in the ink storage chamber 123 has reached a predetermined upper limit.

For example, a signal is transmitted to the controller 55 based on the displacement of the detection lever 127. Upon receipt of the signal transmitted based on the displacement of the detection lever 127 of the upstream damper 23, the controller 55 drives or stops the upstream pump 21. Upon receipt of the signal transmitted based on the displacement of the detection lever 127 of the downstream damper 24, the controller 55 drives or stops the downstream pump 22. With such a structure, the upstream pump 21 and the downstream pump 22 are actuated in accordance with the amount of the ink stored in the upstream damper 23 and the downstream damper 24. In this manner, a predetermined amount of ink is kept in the ink storage chamber 123. Therefore, the ink is supplied to the ink head 11 stably.

As shown in FIG. 4, in this preferred embodiment, the detection lever 127 is coupled with the center 125*c* of the pressure bearing plate 125. The detection lever 127 includes a protrusion portion 127*a* at a position coupled with the pressure bearing plate 125. The pressure bearing plate 125 has a recessed portion 125*a* located at the center 125*c*, which is coupled with the protrusion portion 127*a*. The recessed portion 125*a* is recessed inward with respect to the ink storage chamber 123 such that a tip of the detection lever 127 on the side of the ink storage chamber 123 (i.e., the protrusion portion 127*a*) is insertable into the recessed portion 125*a*. With such an arrangement, the detection lever 127 and the pressure bearing plate 125 are coupled with each other stably. Therefore, the degree of warping deformation of the damper film 122 is transmitted to the detection lever 127 with high precision, and the detection lever 127 is movable stably.

The structure of the upstream damper 23 has been described. The upstream damper 23 and the downstream damper 24 may be provided in one damper main body (not shown). A portion acting as the upstream damper 23 and a portion acting as the downstream damper 24 may be included in the damper main body so as not to overlap each other. In this preferred embodiment, as shown in FIG. 1, the upstream damper 23 and the downstream damper 24 are mounted on the carriage 4 together with the ink head 11. The upstream damper 23 and the downstream damper 24 are located above the ink head 11.

The upstream damper 23 may be provided with a damper filter (not shown) capturing impurities such as sediment or the like in the ink flow channel 20. This significantly reduces or prevents the impurities that may be contained in the ink from flowing into the second upstream portion 15*b* of the upstream flow channel 15 and the ink head 11. As shown in FIG. 2, the upstream damper 23 may include a thermistor 32 to detect the temperature of the ink in the upstream flow channel 15.

The air trap 25 is a device that store air contained in the ink supply system 10 and discharge the stored air outside. The air trap 25 is provided in the connection flow channel 14. In more detail, the air trap 25 is provided between the first connection portion 14*a* and the second connection portion 14*b* of the connection flow channel 14. For example, the air trap 25 includes an ink pouch 33 in which the ink and the air in the ink are stored, and a discharge mechanism 34 discharging the ink in the ink pouch 33 outside. Herein, the expression that the air trap 25 is "stopped" refers to a state where the air in the air trap 25 is not discharged and stored in the air trap 25. The expression that the air trap 25 is "driven" refers to a state where the air stored in the air trap 25 is discharged. In this preferred embodiment, the ink pouch 33 is an example of "air storage portion".

In this preferred embodiment, the air trap 25 may include a thermistor 35*a* and a heater 35*b*. The thermistor 35*a* detects the temperature of the ink in the ink pouch 33 in the air trap 25. The heater 35*b* warms the ink in the ink pouch 33 in the air trap 25.

The inlet valve 26 opens and closes the inlet flow channel 13. The inlet valve 26 opens the inlet flow channel 13, so that the ink stored in the ink tank 12 is supplied to the ink head 11. The inlet valve 26 closes the inlet flow channel 13, so that the ink stored in the ink tank 12 is prohibited from flowing into the ink head 11. In this preferred embodiment, the term "open" encompasses a state where the flow channel to be opened or closed is completely opened and also a state where the flow channel to be opened or closed is not completely opened but is partially opened. Where the state in which the flow channel to be opened or closed is completely opened is 100%, the term "open" may encompass a state where the flow channel to be opened or closed is opened about 80% or about 90%, for example. Depending on the structure of the ink supply system 10, the term "open" may encompass a state where the flow channel is opened, for example, about 10%. In this preferred embodiment, the term "close" is preferably a state where the flow channel to be opened or closed is completely closed. Depending on the structure of the ink supply system 10, the term "close" may encompass a state where a tiny portion of the flow channel to be opened or closed is opened. Where the state in which the flow channel to be opened or closed is completely opened is 100%, the term "close" may encompass a state where the flow channel to be opened or closed is opened, for example, about 1% depending on the structure of the ink supply system 10. In this preferred embodiment, the inlet valve 26 is provided in the inlet flow channel 13. In more detail, the inlet valve 26 is provided between the first inlet portion 13*a* and the second inlet portion 13*b* of the inlet flow channel 13. There is no specific limitation on the type of the inlet valve 26. In this example, the inlet valve 26 is a choke valve.

The outlet valve 27 opens and closes the outlet flow channel 17. The outlet valve 27 opens the outlet flow channel 17, so that the ink in the ink flow channel 20 is discharged outside. The outlet valve 27 closes the outlet flow channel 17, so that the ink in the ink flow channel 20 is prohibited from being discharged outside. In this preferred embodiment, the outlet valve 27 is provided in the outlet flow channel 17. In more detail, the outlet valve 27 is provided between the first outlet portion 17*a* and the outlet middle portion 17*c* of the outlet flow channel 17. There is no specific limitation on the type of the outlet valve 27. In this preferred embodiment, the outlet valve 27 is a choke valve like the inlet valve 26. The outlet valve 27 may be of the same type as that of the inlet valve 26, or may be of a different type from that of the inlet valve 26.

The outlet pump 28 supplies the ink in the ink flow channel 20 or the air contained in the ink to the exhaust liquid tank 29 in the state where the outlet valve 27 opens the outlet flow channel 17. The outlet pump 28 is provided in the outlet flow channel 17. In more detail, the outlet pump 28 is provided in a portion of the outlet flow channel 17 closer to the exhaust liquid tank 29 than the outlet valve 27 is. In this preferred embodiment, the outlet pump 28 is provided between the outlet middle portion 17*c* and the second outlet portion 17*b* of the outlet flow channel 17. There is no specific limitation on the type of the outlet pump 28. In this example, the outlet pump 28 preferably is a tube pump, for example. Although not shown, the outlet pump 28 is connected with a motor. The motor is driven to drive the outlet pump 28.

In this preferred embodiment, the ink supply system 10 includes a cap 51, a cap moving mechanism 52, and a suction pump 53. Although not shown, the cap 51 and the suction pump 53 preferably are located at a home position at the right end of the guide rail 3 (see FIG. 1). Herein, the "home position" is a position where the ink head 11 waits at the time of waiting for printing, namely, while printing is not performed. The cap 51 prevents a situation where the ink attached to the nozzle 11*a* of the ink head 11 is cured and clogs the nozzle 11*a*. The cap 51 is attached to the ink head 11 to cover the nozzle 11*a* of the ink head 11 at the time of waiting for printing, namely, while printing is not performed. The cap moving mechanism 52 is connected with the cap 51. The cap moving mechanism 52 moves the cap 51 toward the bottom surface of the ink head 11 at the home position. There is no specific limitation on the structure of the cap moving mechanism 52. For example, the cap moving mechanism 52 may include a driving motor. The driving motor is driven to move the cap 51.

The suction pump 53 absorbs the ink in the ink head 11 in the state where the cap 51 is attached to the ink head 11. The suction pump 53 is connected with the cap 51. In this example, the cap 51 and the exhaust liquid tank 29 are connected with each other by a suction flow channel 54 including a tube. The suction pump 53 is provided in the middle of the suction flow channel 54. The ink absorbed by the suction pump 53 is stored in the exhaust liquid tank 29.

Figure 5:
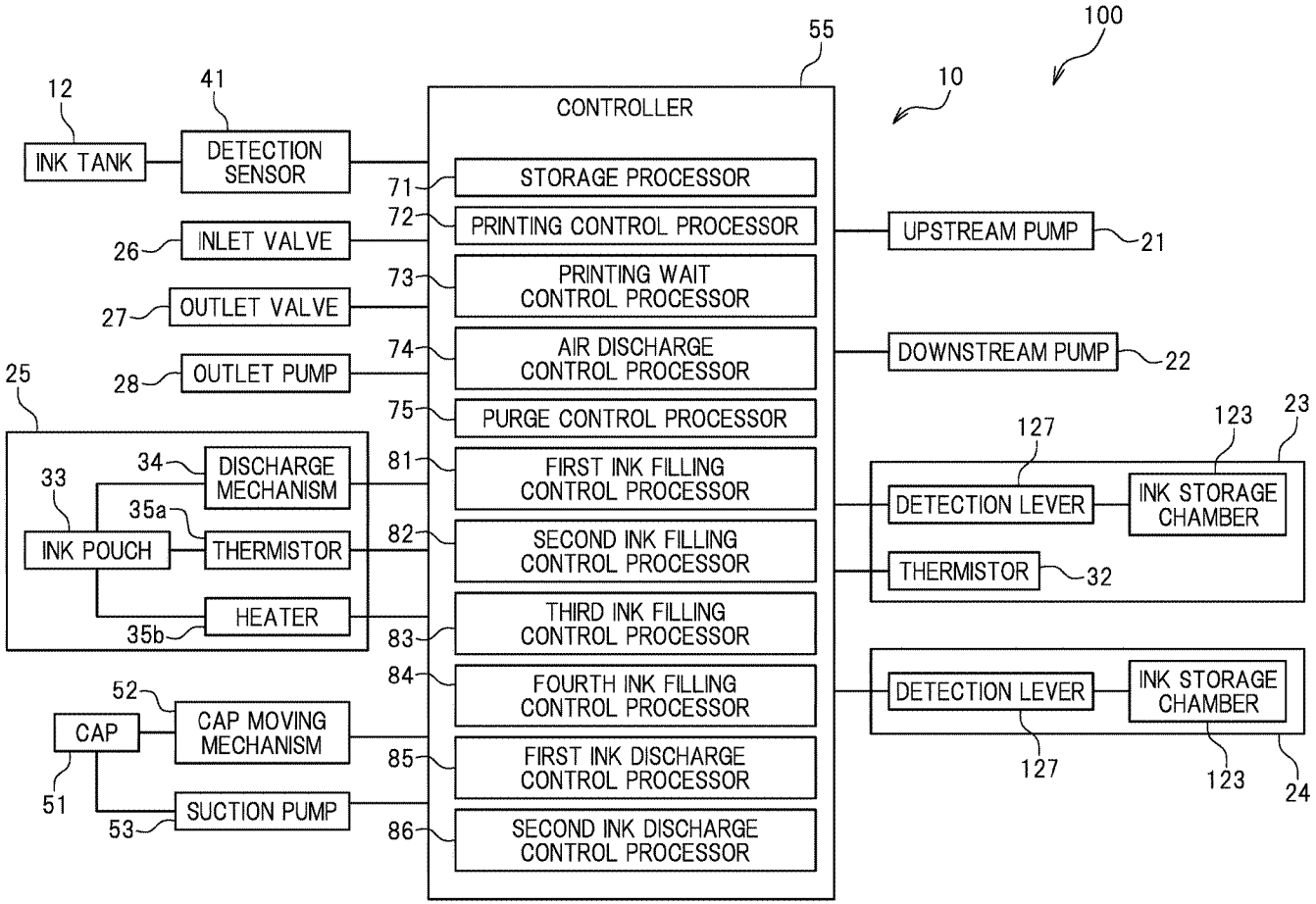
FIG. 5 is a block diagram of the printer.

FIG. 5 is a block diagram of the printer 100. In this preferred embodiment, as shown in FIG. 5, the ink supply system 10 includes a controller 55. The controller 55 executes controls on the ink supply system 10. In this example, the controller 55, for example, controls the supply of the ink to the ink head 11. There is no specific limitation on the structure of the controller 55. For example, the controller 55 may be a computer, and may include a central processing unit (hereinafter, referred to as a "CPU"), a ROM storing a program to be executed by the CPU, a RAM, and the like.

The controller 55 is connected with the detection sensor 41 provided in the ink tank 12, and detects the amount of the ink stored in the ink tank 12 by use of the detection sensor 41. The controller 55 is connected with the upstream pump 21 and the detection lever 127 of the upstream damper 23. The detection lever 127 of the upstream damper 23 detects the amount of the ink in the ink storage chamber 123 of the upstream damper 23, and the controller 55 controls the driving on the upstream pump 21 based on the detection results. The controller 55 is connected with the downstream pump 22 and the detection lever 127 of the downstream damper 24. The detection lever 127 of the downstream damper 24 detects the amount of the ink in the ink storage chamber 123 of the downstream damper 24, and the controller 55 controls the driving on the downstream pump 22 based on the detection results.

The controller 55 is connected with the thermistor 32 provided in the upstream damper 23, and detects the temperature of the ink in the upstream flow channel 15 by use of the thermistor 32. The controller 55 is connected with the discharge mechanism 34 of the air trap 25. In order to discharge the air in the ink pouch 33, the controller 55 controls the discharge mechanism 34 to discharge the air. The controller 55 is connected with the thermistor 35*a* provided in the air trap 25, and detects the temperature of the ink in the ink pouch 33 of the air trap 25 by use of the thermistor 35*a*. The controller 55 is connected with the heater 35*b* of the air trap 25, and controls the heater 35*b* to warm the ink in the ink pouch 33. The controller 55 is connected with the inlet valve 26, and controls the inlet valve 26 to open or close the inlet flow channel 13. The controller 55 is connected with the outlet valve 27, and controls the outlet valve 27 to open or close the outlet flow channel 17. The controller 55 is connected with the outlet pump 28, and controls the outlet pump 28 to discharge the ink in the ink flow channel 20 to the exhaust liquid tank 29. The controller 55 is connected with the cap moving mechanism 52, and controls the cap moving mechanism 52 to control the movement of the cap 51. The controller 55 is connected with the suction pump 53, and controls, for example, the timing to absorb the ink in the ink head 11 in the state where the cap 51 is attached to the ink head 11.

In this preferred embodiment, the controller 55 includes a storage processor 71, a printing control processor 72, a printing wait control processor 73, an air discharge control processor 74, a purge control processor 75, a first ink filling control processor 81, a second ink filling control processor 82, a third ink filling control processor 83, a fourth ink filling control processor 84, a first ink discharge control processor 85, and a second ink discharge control processor 86. Specific controls on the above-described processors and the like will be described below.

The structure of the printer 100 including the ink supply system 10 has been described. In this preferred embodiment, states of the components controlled by the controller 55 (in more detail, the upstream pump 21, the downstream pump 22, the air trap 25, the inlet valve 26, the outlet valve 27, and the outlet pump 28, the suction pump 53, etc.), among the components included in the ink supply system 100, include a printing state, a printing wait state, an air discharge state, a purge state, an ink filling state, and an ink discharge state. Hereinafter, the control executed by the controller 55 in each state will be described.

Figure 6:
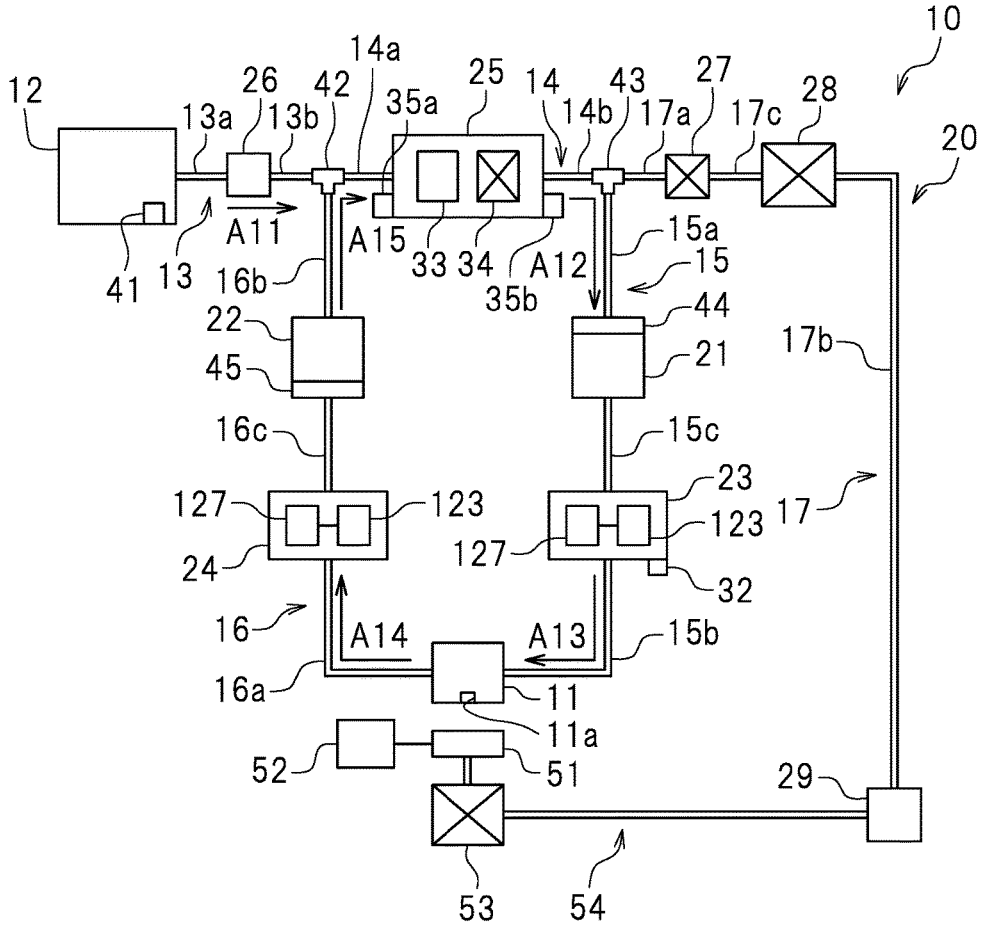
FIG. 6 is a schematic view of the ink supply system in a printing state.

First, the control executed by the controller 55 in the printing state will be described. FIG. 6 is a schematic view of the ink supply system 10 in the printing state. In each of the figures, "X" used for each of the inlet valve 26 and the outlet valve 27 indicates that each of the inlet valve 26 and the outlet valve 27 is closed. "X" used for each of the upstream pump 21, the downstream pump 22, the discharge mechanism 34 of the air trap 25, the outlet pump 28, and the suction pump 53 indicates that each of the upstream pump 21, the downstream pump 22, the discharge mechanism 34 of the air trap 25, the outlet pump 28, and the suction pump 53 is stopped. In each of the figures, the arrows represent the flow of the ink. As shown in FIG. 6, the printing state is a state where printing is performed on the recording medium 5. The printing state is a state where the ink is ejected from the nozzle 11*a* of the ink head 11 toward the recording medium 5 placed on the platen 7. In the printing state, the ink stored in the ink tank 12 is supplied to the ink head 11. In the printing state, the printing control processor 72 (see FIG. 5) of the controller 55 executes the control. In the printing state, the printing control processor 72 opens the inlet valve 26 and closes the outlet valve 27. As a result, the inlet flow channel 13 is opened and the outlet flow channel 17 is closed. In the printing state, the printing control processor 72 drives the upstream pump and the downstream pump 22. In more detail, the printing control processor 72 controls the driving on the upstream pump 21 and the downstream pump 22 based on the detection results of the amount of the ink stored in the ink storage chamber 123 provided by the detection lever 127 of the upstream damper 23 and the detection results of the amount of the ink stored in the ink storage chamber 123 provided by the detection lever 127 of the downstream damper 24, so that the pressure in the ink head 11 is of a negative value. As a result, the ink is ejected from the nozzle 11*a* of the ink head 11. In the printing state, the printing control processor 72 executes control such that the discharge mechanism 34 of the air trap 25, the outlet pump 28, and the suction pump 53 are stopped. In the printing state, the cap 51 is not attached to the ink head 11.

In this preferred embodiment, in the printing state, the inlet valve 26 is opened. Therefore, the ink stored in the ink tank 12 flows into the connection flow channel 14 via the inlet flow channel 13 as represented by arrow A11. In the printing state, the outlet valve 27 is closed and the upstream pump 21 and the downstream pump 22 are driven. Therefore, the ink in the connection flow channel 14 does not flow into the outlet flow channel 17 but flows into the upstream flow channel 15 as represented by arrow A12. Since the upstream pump 21 is driven, the ink in the upstream flow channel 15 is supplied to the ink head 11 as represented by arrow A13. In the printing state, the printing control processor 72 controls the driving on the upstream pump 21 and the downstream pump 22 such that the pressure in the ink head 11 is of a negative value. Therefore, a portion of the ink in the ink head 11 is ejected from the nozzle 11*a* toward the recording medium 5. Since the downstream pump 22 is driven, the remaining portion of the ink in the ink head 11 flows into the downstream flow channel 16 as represented by arrow A14. The ink in the downstream flow channel 16 flows into the connection flow channel 14 as represented by arrow A15. In this manner, in the printing state, the ink circulates in the ink flow channel 20 while flowing in the connection flow channel 14, the upstream flow channel 15 and the downstream flow channel 16.

Figure 7:
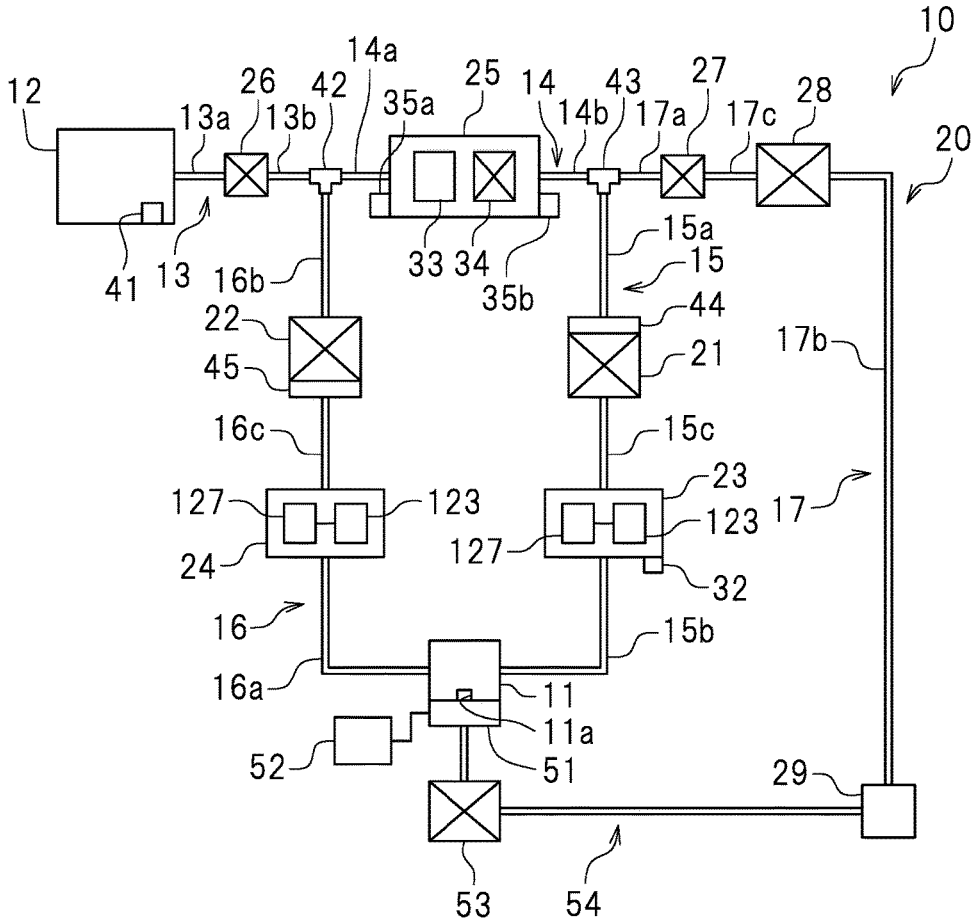
FIG. 7 is a schematic view of the ink supply system in a printing wait state.

Now, the control executed by the controller 55 in the printing wait state will be described. FIG. 7 is a schematic view of the ink supply system 10 in the printing wait state. As shown in FIG. 7, the printing wait state is a state where the printing is not performed on the recording medium 5, and the ink head 11 waits at the home position. In the printing wait state, the printing wait control processor 73 (see FIG. 5) of the controller 55 executes the control. In the printing wait state, the printing wait control processor 73 closes the inlet valve 26 and the outlet valve 27. As a result, the inlet flow channel 13 and the outlet flow channel 17 are closed. In the printing wait state, the printing wait control processor 73 stops the upstream pump 21 and the downstream pump 22. In the printing wait state, the printing wait control processor 73 stops the discharge mechanism 34 of the air trap 25, the outlet pump 28, and the suction pump 53. The cap 51 is attached to the ink head 11.

In the printing wait state, the inlet valve 26 is closed. Therefore, the ink stored in the ink tank 12 does not flow into the connection flow channel 14. Since the outlet valve 27 is closed, the ink in the connection flow channel 14 does not flow into the outlet flow channel 17. Since the upstream pump 21 and the downstream pump 22 are stopped, the ink is not supplied to the ink head 11, and the ink is not ejected from the ink head 11. In the printing wait state, the ink does not circulate in the ink flow channel 20.

Figure 8:
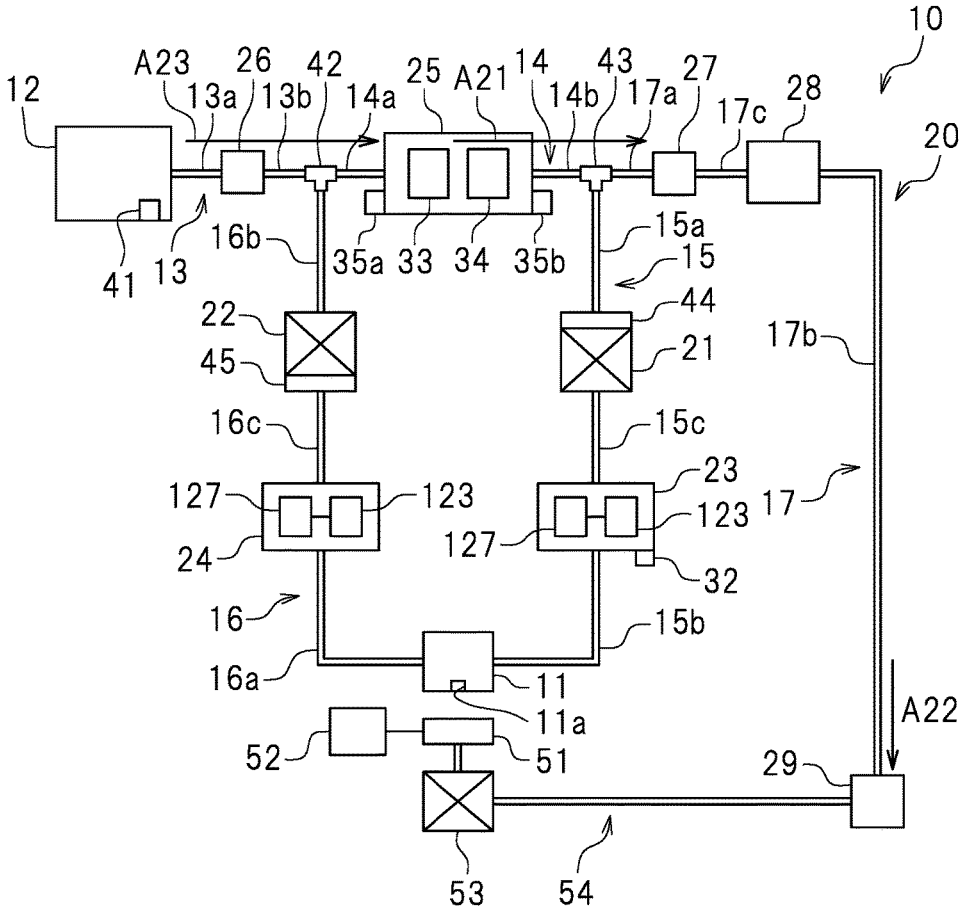
FIG. 8 is a schematic view of the ink supply system in an air discharge state.

Now, the control executed by the controller 55 in the air discharge state will be described. FIG. 8 is a schematic view of the ink supply system 10 in the air discharge state. As shown in FIG. 8, the air discharge state is a state where the air stored in the ink pouch 33 of the air trap 25 is discharged outside. In the air discharge state, the air discharge control processor 74 (see FIG. 5) of the air trap 25 executes the control. In this preferred embodiment, in the air discharge state, the air discharge control processor 74 opens the inlet valve 26 and the outlet valve 27. Therefore, the inlet flow channel 13 and the outlet flow channel 17 are opened. In the air discharge state, the air discharge control processor 74 stops the upstream pump 21 and the downstream pump 22, and drives the discharge mechanism 34 of the air trap 25. In the air discharge state, the air discharge control processor 74 executes control such that the outlet pump 28 is driven, and the suction pump 53 is stopped. In FIG. 8, in the air discharge state, the cap 51 is not attached to the ink head 11. Alternatively, the cap 51 may be attached to the ink head 11.

In this preferred embodiment, in the air discharge state, the outlet valve 27 is opened, and the discharge mechanism 34 of the air trap 25 and the outlet pump 28 are driven. Therefore, the air stored in the ink pouch 33 flows into the outlet flow channel 17 together with the ink in the ink pouch 33 as represented by arrow A21, and is discharged into the exhaust liquid tank 29 as represented by arrow A22. At this point, the upstream pump 21 and the downstream pump 22 are stopped. Therefore, neither the air nor the ink in the ink pouch 33 of the air trap 25 flows into the upstream flow channel 15. In the air discharge state, the inlet valve 26 is opened. Therefore, the air and the ink in the ink pouch 33 of the air trap 25 are discharged, and thus the ink stored in the ink tank 12 is supplied into the ink pouch 33 via the inlet flow channel 13 as represented by arrow A23.

Figure 9:
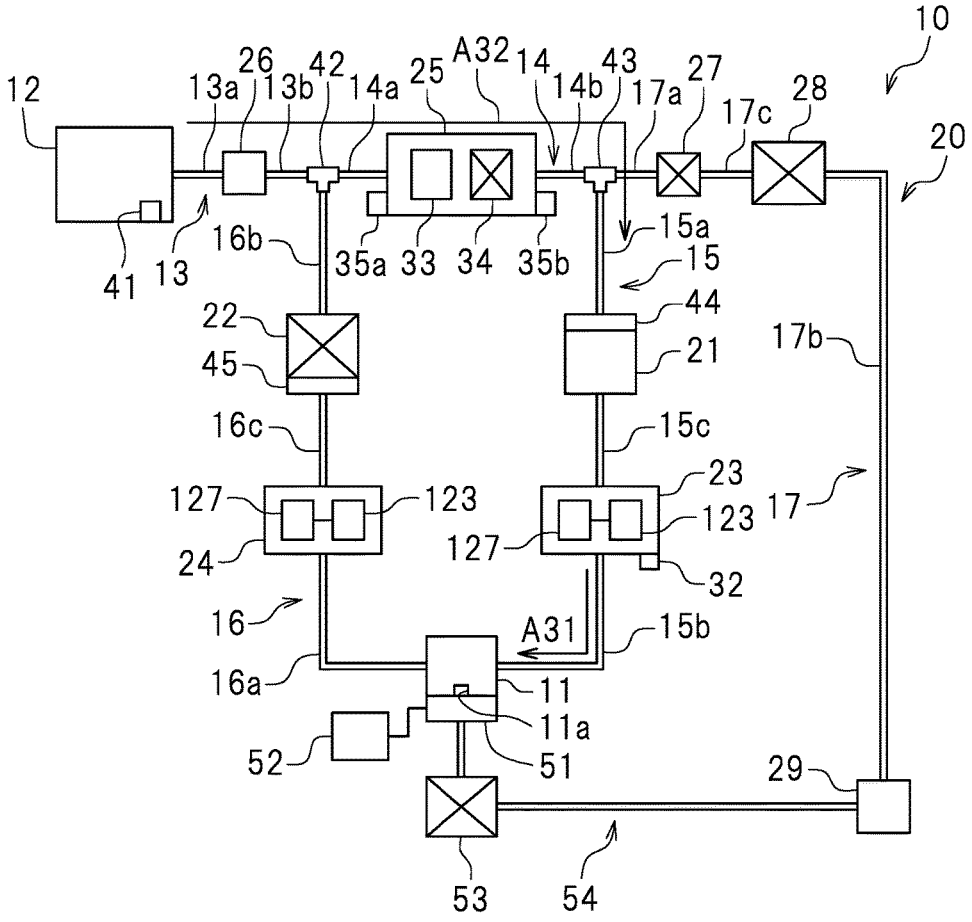
FIG. 9 is a schematic view of the ink supply system in a purge state.

Now, the control executed by the controller 55 in the purge state will be described. FIG. 9 is a schematic view of the ink supply system 10 in the purge state. In this preferred embodiment, as shown in FIG. 9, when the nozzle 11*a* of the ink head 11 has an ejection fault, purging is performed in order to solve the ejection fault. In the purge state, the purge control processor 75 (see FIG. 5) of the controller 55 executes the control. In the purge state, the ink head 11 is located at the home position. At this point, the purge control processor 75 controls the cap moving mechanism 52 to attach the cap 51 to the ink head 11. In the purge state, the ink is ejected from the nozzle 11*a* of the ink head 11 toward the cap 51. In this preferred embodiment, in the purge state, the purge control processor 75 opens the inlet valve 26 and closes the outlet valve 27. As a result, the inlet flow channel 13 is opened and the outlet flow channel 17 is closed. The purge control processor 75 drives the upstream pump 21 and stops the downstream pump 22. Alternatively, the purge control processor 75 may control the downstream pump 22 to decrease the flow rate of the ink to be supplied. In the purge state, the purge control processor 75 executes control such that the discharge mechanism 34 of the air trap 25, and the outlet pump 28 and the suction pump 53 are stopped.

In this preferred embodiment, in the purge state, the upstream pump 21 is driven. Therefore, the ink head 11 is pressurized. As a result, the ink in the upstream flow channel 15 is supplied to the ink head 11 as represented by arrow A31, and the ink is ejected from the nozzle 11*a* of the ink head 11 toward the cap 51. In the purge state, the downstream pump 22 is stopped. Therefore, the ink in the ink head 11 does not flow into the downstream flow channel 16. Namely, in the purge state, the ink does not circulate. In the purge state, since the inlet valve 26 is opened, the ink stored in the ink tank 12 flows into the upstream flow channel 15 via the inlet flow channel 13 and the connection flow channel 14 as represented by arrow A32.

Figure 12:
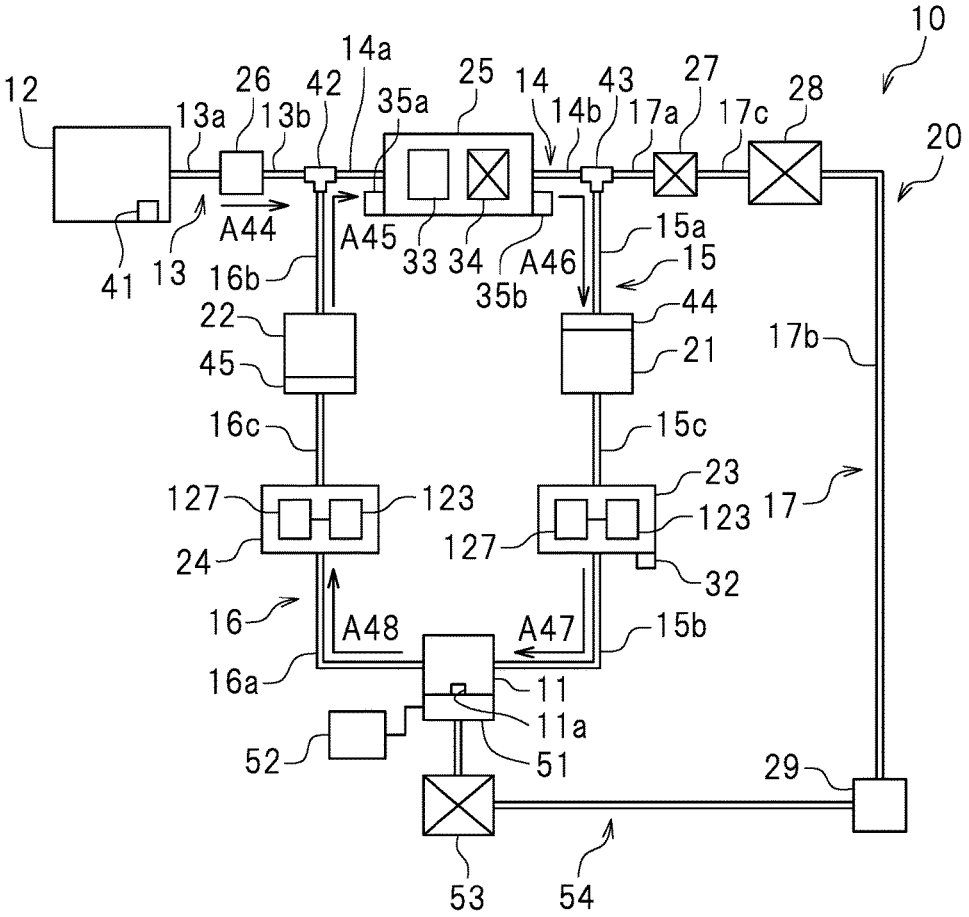
FIG. 12 is a schematic view of the ink supply system in third filling control in the ink filling state.
Figure 13:
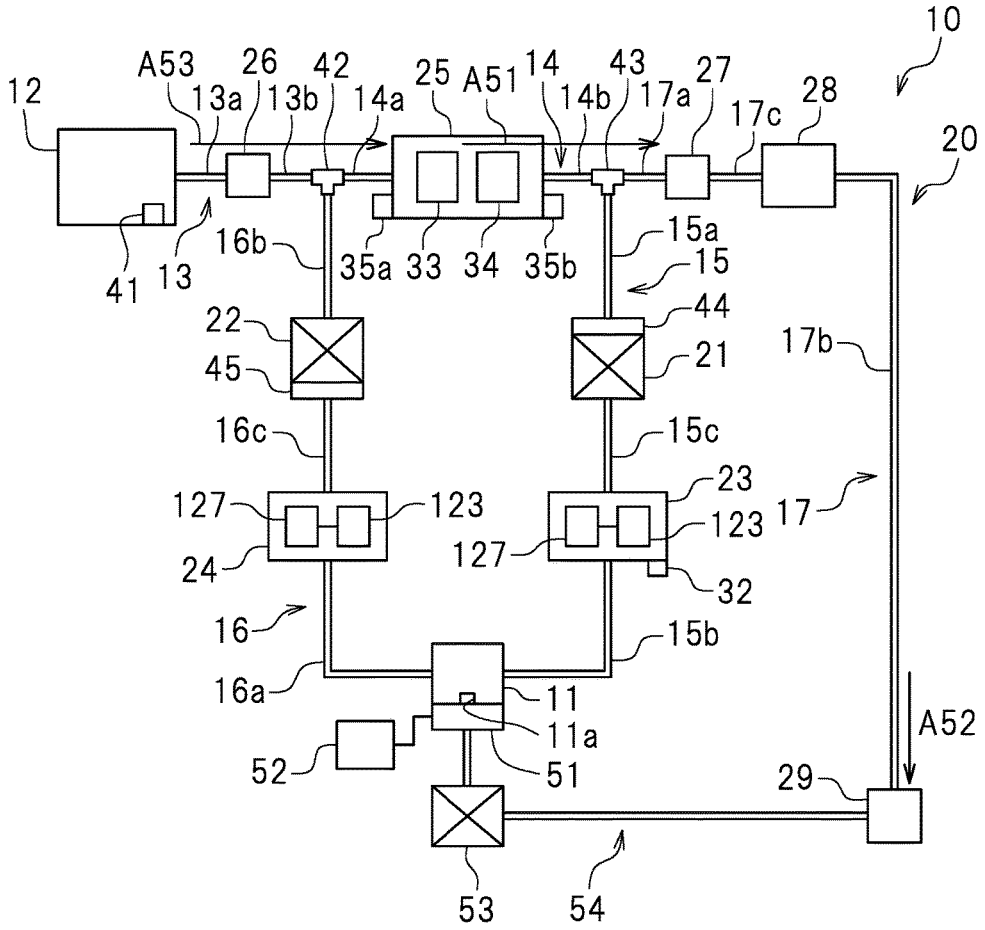
FIG. 13 is a schematic view of the ink supply system in fourth filling control in the ink filling state.
Figure 14:
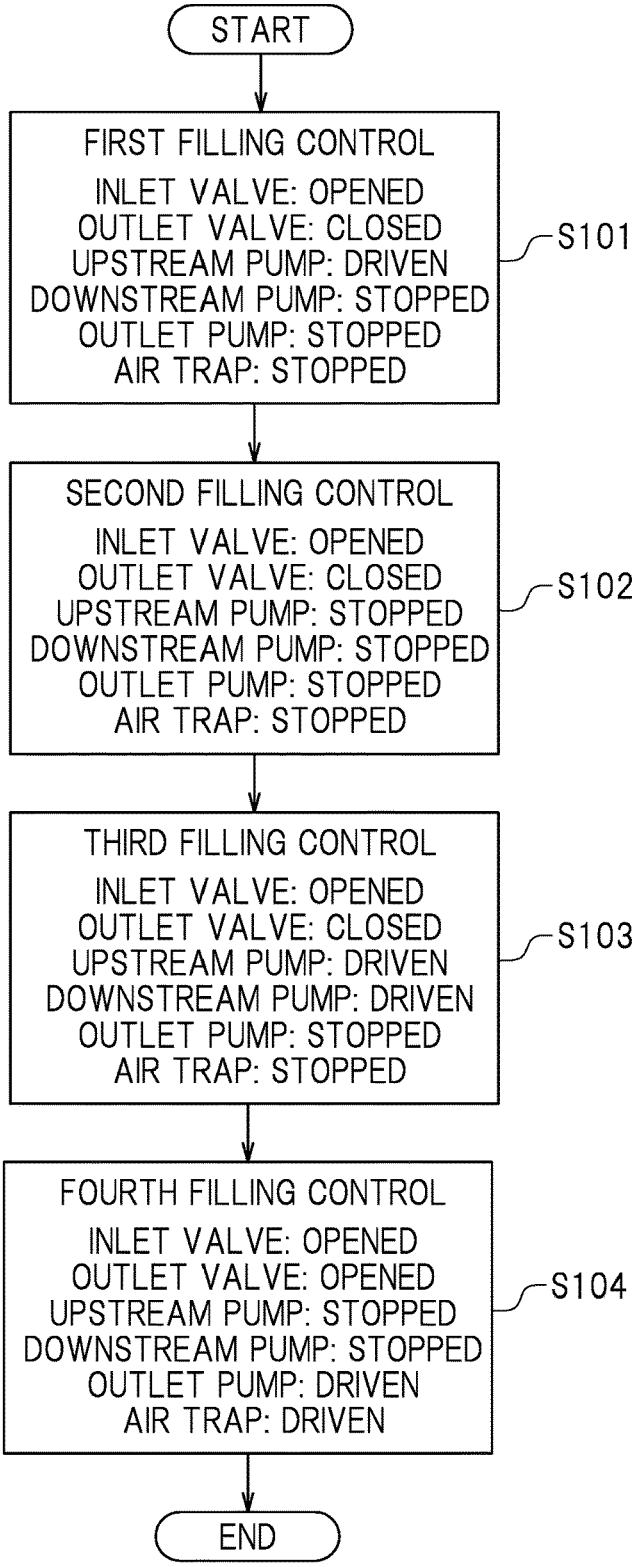
FIG. 14 is a flowchart showing a procedure of control executed by a controller in the ink filling state.

Now, the control executed by the controller 55 in the ink filling state will be described. FIG. 10 through FIG. 13 are each a schematic view of the ink supply system 10 in the ink filling state. FIG. 14 is a flowchart showing a procedure of control executed by the controller 55 in the ink filling state. In this preferred embodiment, the ink filling state is a state where the ink flow channel 20 is filled with ink. The expression "filled with ink" refers to that when, for example, the ink flow channel 20 is empty, the ink flow channel 20 is filled with the ink stored in the ink tank 12. The expression that the "ink flow channel 20 is empty" encompasses a case where the air trap 25 is empty.

Figure 10:
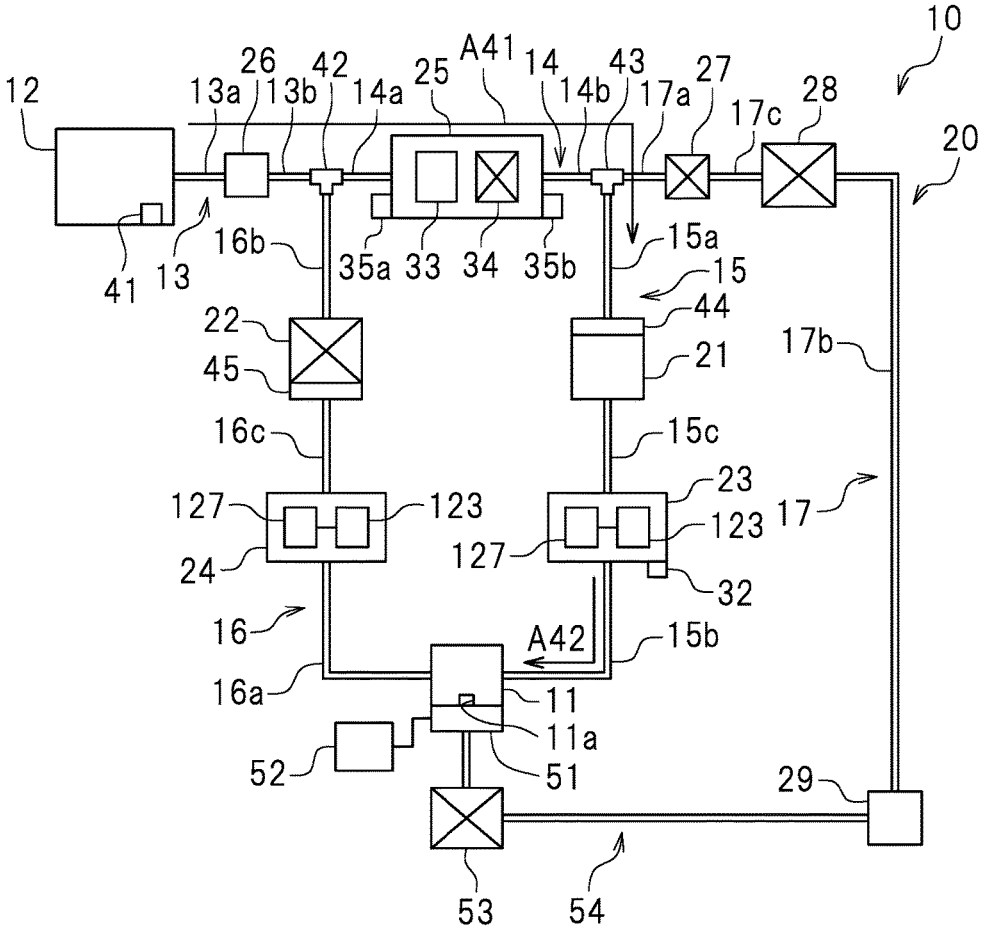
FIG. 10 is a schematic view of the ink supply system in first filling control in an ink filling state.

In the ink filling state, as shown in FIG. 5, the first ink filling control processor 81, the second ink filling control processor 82, the third ink filling control processor 83, and the fourth ink filling control processor 84 of the controller 55 execute the control. As shown in FIG. 14, in the ink filling state, first filling control, second filling control, third filling control and fourth filling control are executed sequentially. First in step S101, the first ink filling control processor 81 executes the first filling control. Specifically, as shown in FIG. 10, the first ink filling control processor 81 opens the inlet valve 26 and closes the outlet valve 27. The first ink filling control processor 81 drives the upstream pump 21 and stops the downstream pump 22. The first ink filling control processor 81 stops the discharge mechanism 34 of the air trap 25, the outlet pump 28 and the suction pump 53. In the first filling control, the first ink filling control processor 81 may control the cap moving mechanism 52 to attach the cap 51 to the ink head 11. Alternatively, in the ink filling state, the cap 51 does not need to be attached to the ink head 11. The first ink filling control processor 81 executes the first filling control, so that the ink stored in the ink tank 12 is supplied to the inlet flow channel 13, the connection flow channel 14 and the upstream flow channel 15 as represented by arrows A41 and A42, and the inlet flow channel 13, the connection flow channel 14 and the upstream flow channel 15 are filled with the ink. In the first filling control, since the downstream pump 22 is stopped, the ink does not flow from the ink head 11 into the downstream flow channel 16. In the first filling control, since the upstream pump 21 is driven, the ink in the ink tank 12 is not stored in the ink pouch 33 of the air trap 25 and flows into the upstream flow channel 15 with priority.

Figure 11:
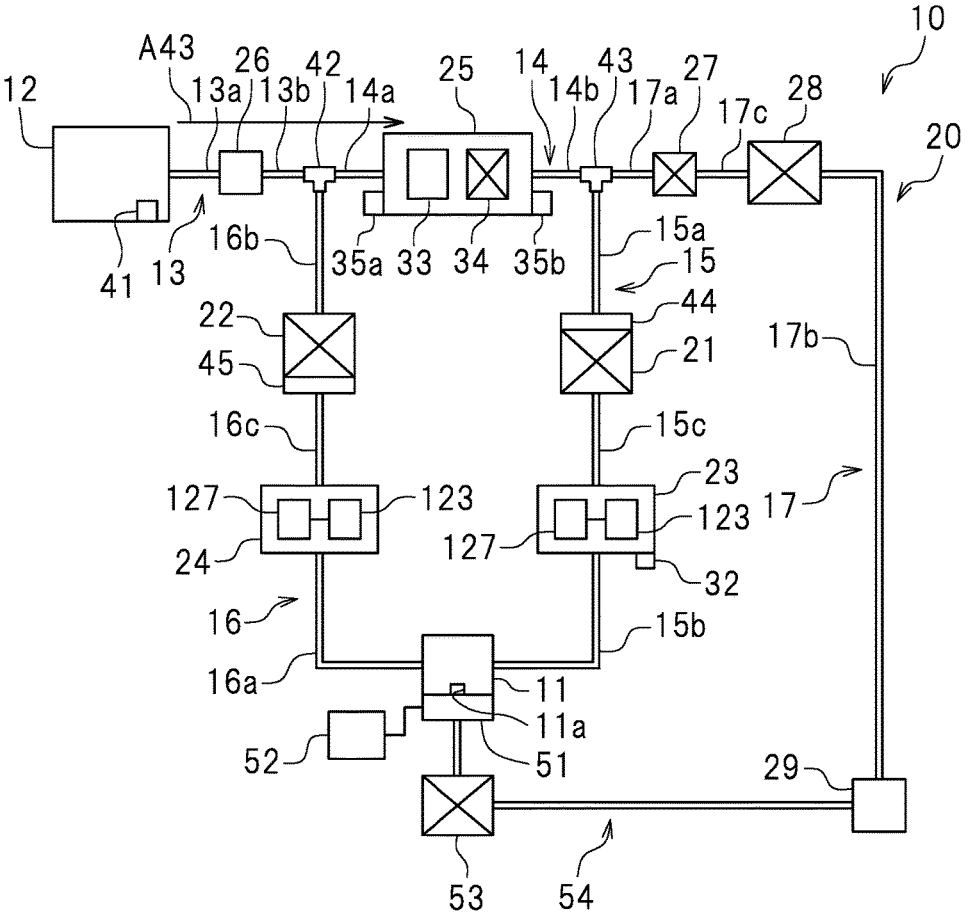
FIG. 11 is a schematic view of the ink supply system in second filling control in the ink filling state.

After the first filling control, in step S102 in FIG. 14, the second ink filling control processor 82 executes the second filling control. As shown in FIG. 11, in the second filling control, the second ink filling control processor 82 stops the upstream pump 21, which has been driven. In the second filling control, the inlet valve 26 is opened. The outlet valve 27 is closed. The downstream pump 22, the discharge mechanism 34 of the air trap 25, the outlet pump 28 and the suction pump 53 are stopped. The second ink filling control processor 82 executes the second filling control, so that the ink stored in the ink tank 12 is not supplied to the upstream flow channel 15 but is stored in the ink pouch 33 of the air trap 25 as represented by arrow A43. The second filling control is executed until the amount of the ink in the ink pouch 33 of the air trap 25 reaches a predetermined level. For example, the storage processor 71 of the controller 55 has, stored thereon in advance, a predetermined time period expected to be needed until the amount of the ink in the ink pouch 33 reaches the predetermined level from the start of the second filling control. When the time period of the second filling control becomes longer than, or equal to, the predetermined time period, the second ink filling control processor 82 determines that the amount of the ink in the ink pouch 33 has reached the predetermined level and finishes the second filling control.

After the second filling control is finished, in step S103 in FIG. 14, the third ink filling control processor 83 executes the third filling control. As shown in FIG. 12, in the third filling control, the third ink filling control processor 83 drives the upstream pump 21 and the downstream pump 22, which have been stopped. In the third filling control, the inlet valve 26 is opened and the outlet valve 27 is closed. The discharge mechanism 34 of the air trap 25, the outlet pump 28 and the suction pump 53 are stopped. The third ink filling control processor 83 executes the third filling control, so that the ink in the ink tank 12 flows into the connection flow channel 14 via the inlet flow channel 13 as represented by arrow A44. The ink in the ink flow channel 20 circulates while flowing in the connection flow channel 14, the upstream flow channel 15 and the downstream flow channel 16 as represented by arrows A45, A46, A47 and A48. Therefore, the downstream flow channel 16 is filled with the ink. At this point, the air in the downstream flow channel 16 is stored in the ink pouch 33 of the air trap 25. In the third filling control, it is preferred that the third ink filling control processor 83 controls the driving on the upstream pump 21 and the downstream pump 22 such that the ink does not leak from the ink head 11.

After the third filling control is finished, in step S104 in FIG. 14, the fourth ink filling control processor 84 executes the fourth filling control. As shown in FIG. 13, in the fourth filling control, the fourth ink filling control processor 84 opens the outlet valve 27, which has been closed, and drives the discharge mechanism 34 of the air trap 25 and the outlet pump 28, which have been stopped. The fourth ink filling control processor 84 stops the upstream pump 21 and the downstream pump 22, which have been driven. In the fourth filling control, the inlet valve 26 is opened and the suction pump 53 is stopped. The fourth ink filling control processor 84 executes the fourth filling control, so that the air stored in the ink pouch 33 of the air trap 25 flows into the outlet flow channel 17 together with the ink in the ink pouch 33 as represented by arrow A51, and then is discharged into the exhaust liquid tank 29 as represented by arrow A52. In the fourth filling control, since the upstream pump 21 is not driven, neither the air nor the ink in the ink pouch 33 of the air trap 25 flows into the upstream flow channel 15. In the fourth filling control, since the inlet valve 26 is opened, the air and the ink in the ink pouch 33 of the air trap 25 are discharged and thus the ink stored in the ink tank 12 is supplied to the ink pouch 33 via the inlet flow channel 13 as represented by arrow A53. In this manner, the ink flow channel 20 is filled with the ink.

Figure 15:
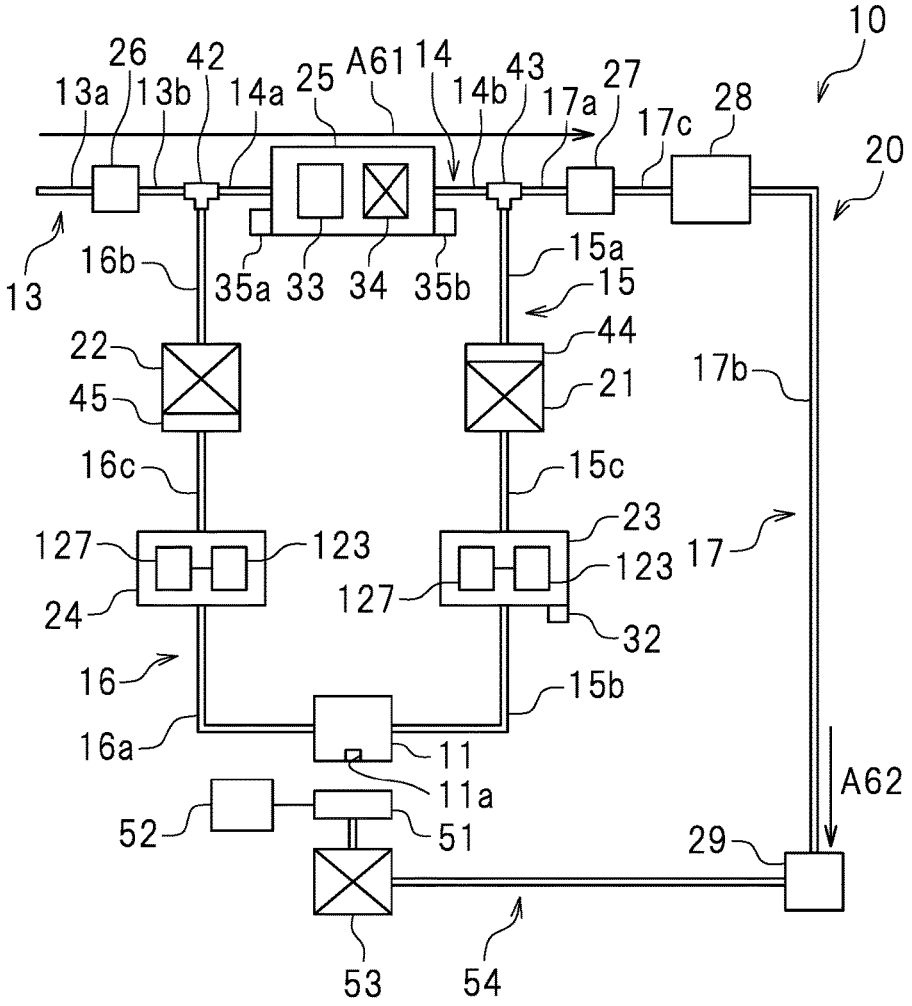
FIG. 15 is a schematic view of the ink supply system in first discharge control in an ink discharge state.
Figure 16:
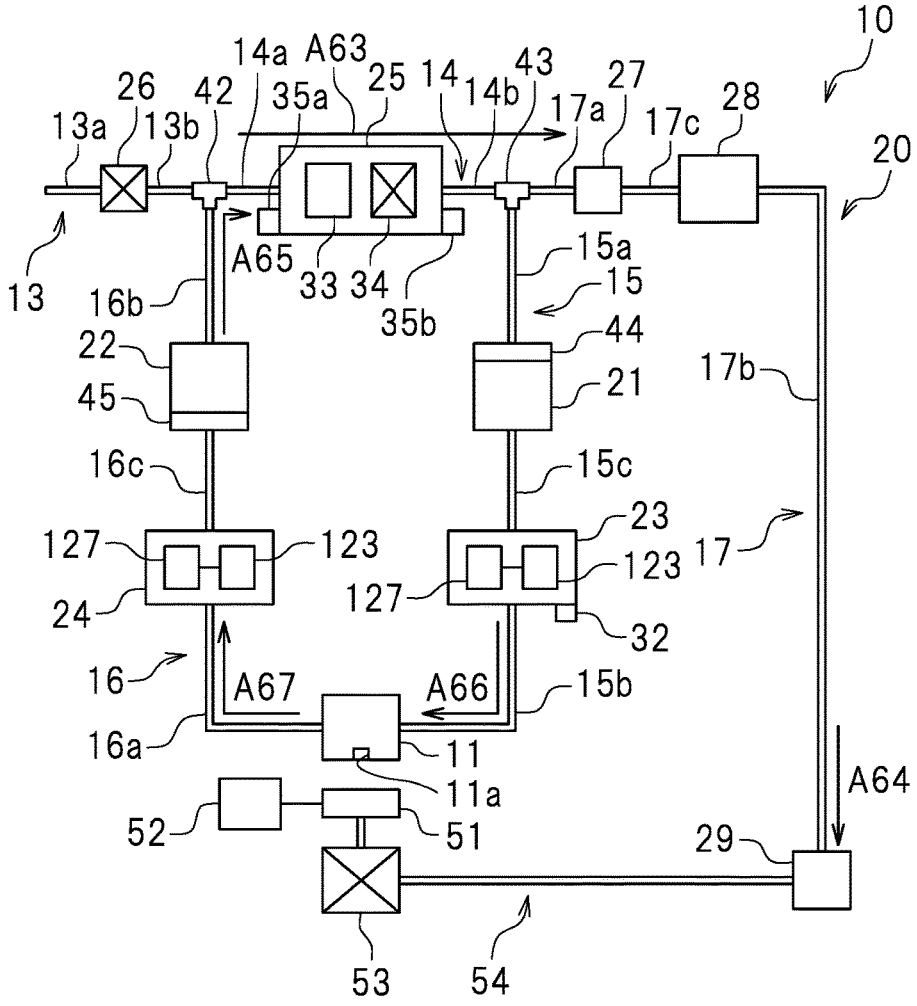
FIG. 16 is a schematic view of the ink supply system in second discharge control in the ink discharge state.
Figure 17:
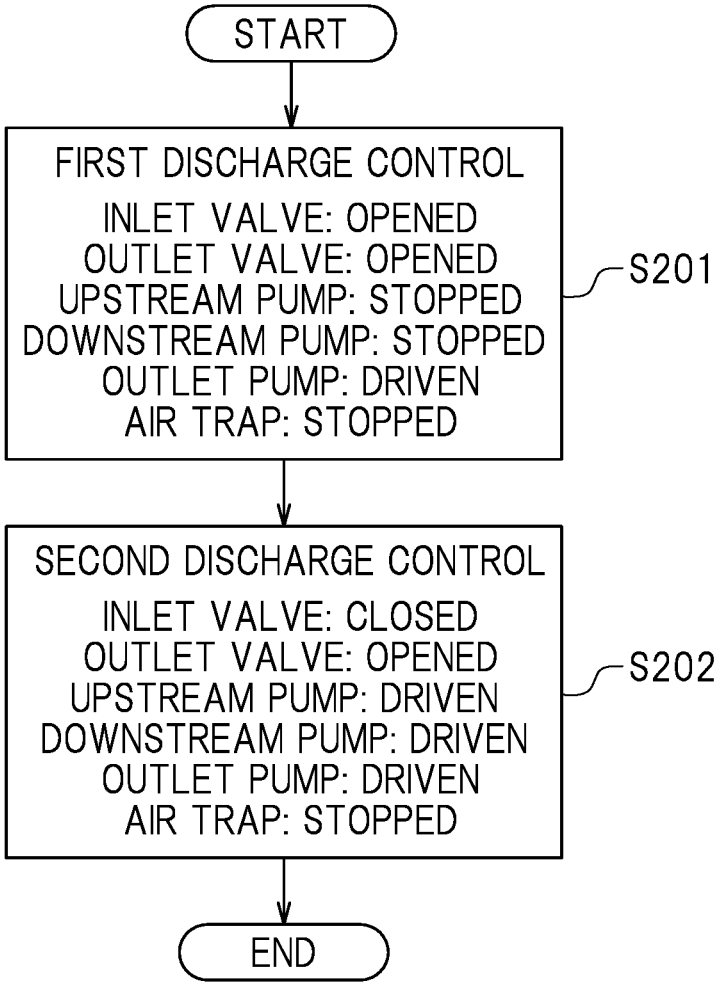
FIG. 17 is a flowchart showing a procedure of control executed by the controller in the ink discharge state.

Now, the control executed by the controller 55 in the ink discharge state will be described. FIG. 15 and FIG. 16 are each a schematic view of the ink supply system 10 in the ink discharge state. FIG. 17 is a flowchart showing a procedure of control executed by the controller 55 in the ink discharge state. In this preferred embodiment, the expression "ink discharge state" refers to a state where the ink in the ink flow channel 20 is discharged. For example, in order to move the printer 100 to another site, the printer 100 is put into the ink discharge state to discharge the ink in the ink flow channel 20 outside. As shown in FIG. 15, in the ink discharge state, the ink tank 12 is detached from the inlet flow channel 13. The inlet flow channel 13 is structured such that when the ink tank 12 is detached from the one end of the inlet flow channel 13, the ink does not leak from the one end thereof.

In the ink discharge state, as shown in FIG. 5, the first ink discharge control processor 85 and the second ink discharge control processor 86 of the controller 55 execute the control. In the ink discharge state, as shown in FIG. 17, first discharge control and second discharge control preferably are executed sequentially, for example. First in step S201, the first ink discharge control processor 85 executes the first discharge control. Specifically, as shown in FIG. 15, the first ink discharge control processor 85 opens the inlet valve 26 and the outlet valve 27 in the state where the ink tank 12 is detached from the inlet flow channel 13. As a result, the inlet flow channel 13 and the outlet flow channel 17 are opened. The first ink discharge control processor 85 stops the upstream pump 21, the downstream pump 22 and the discharge mechanism 34 of the air trap 25. The first ink discharge control processor 85 drives the outlet pump 28 and stops the suction pump 53. In the ink discharge state, the cap 51 is not attached to the ink head 11.

In the first discharge control, the upstream pump 21 and the downstream pump 22 are stopped. Therefore, the ink does not circulate in the ink flow channel 20, and the ink in the connection flow channel 14 does not flow into the upstream flow channel 15. In the first discharge control, the inlet flow channel 13 and the outlet flow channel 17 are opened, and the outlet pump 28 is driven. Therefore, the ink in the inlet flow channel 13 is discharged into the exhaust liquid tank 29 via the connection flow channel 14 and the outlet flow channel 17 as represented by arrows A61 and A62. In the ink discharge state, since the ink tank 12 is not connected with the inlet flow channel 13, the inlet flow channel 13 is not supplied with the ink and thus is empty.

After the first discharge control is finished, in step S202 in FIG. 17, the second ink discharge control processor 86 executes the second discharge control. As shown in FIG. 16, in the second discharge control, the second ink discharge control processor 86 closes the inlet valve 26, which has been opened, and drives the upstream pump 21 and the downstream pump 22, which have been stopped. In the second discharge control, the outlet valve 27 is opened. The discharge mechanism 34 of the air trap 25 is stopped, but may be driven. The outlet pump 28 is driven, and the suction pump 53 is stopped. In the second discharge control, the ink in the outlet flow channel 17 is discharged into the exhaust liquid tank 29 as represented by arrow A64. The ink in the connection flow channel 14 is discharged into the exhaust liquid tank 29 via the outlet flow channel 17 as represented by arrows A63 and A64. In the second discharge control, since the downstream pump 22 is driven, the ink in the downstream flow channel 16 is discharged into the exhaust liquid tank 29 via the connection flow channel 14 and the outlet flow channel 17 as represented by arrows A65, A63 and A64. Since the upstream pump 21 is driven, the ink in the upstream flow channel 15 is discharged into the exhaust liquid tank 29 via the downstream flow channel 16, the connection flow channel 14 and the outlet flow channel 17 as represented by arrows A66, A67, A65, A63 and A64. In this manner, in the second discharge control, the ink in the connection flow channel 14, the upstream flow channel 15, the downstream flow channel 16 and the outlet flow channel 17 is discharged. Therefore, in the ink discharge state, the ink in the ink flow channel 20 is discharged by the first discharge control and the second discharge control.

In this preferred embodiment, as shown in FIG. 6, in the printing state, the printing control processor 72 opens the inlet valve 26 and closes the outlet valve 27. The printing control processor 72 drives the upstream pump 21 and the downstream pump 22. As a result, the ink stored in the ink tank 12 is supplied to the ink head 11 via the inlet flow channel 13, the connection flow channel 14, and the upstream flow channel 15 as represented by arrows A11, A12 and A13. A portion of the ink in the ink head 11 flows into the downstream flow channel 16. In this preferred embodiment, since the outlet valve 27 is closed, the ink does not flow into the outlet flow channel 17. The ink circulates while flowing in the upstream flow channel 15, the downstream flow channel 16 and the connection flow channel 14 as represented by arrows A12, A13, A14 and A15. Therefore, the ink is prevented from being kept stored in the ink head 11. In this preferred embodiment, the upstream pump 21 and the upstream damper 23 are provided in the upstream flow channel 15 upstream with respect to the ink head 11, and the downstream pump 22 and the downstream damper 24 are provided in the downstream flow channel 16 downstream with respect to the ink head 11. Therefore, based on the flow rate of the ink flowing into the upstream damper 23 and the flow rate of the ink flowing into the downstream damper 24, the pressure change is significantly reduced or prevented upstream and downstream with respect to the ink head 11, and thus the driving on the upstream pump 21 and the downstream pump 22 is controlled. For this reason, the pressure in the ink head 11 is easily kept at a negative value, and thus the ink is easily ejected from the ink head 11 properly.

In this preferred embodiment, for example, as shown in FIG. 4, a signal is transmitted to the controller 55 based on the displacement of the detection lever 127. Upon receipt of the signal transmitted based on the displacement of the detection lever 127 of the upstream damper 23, the controller 55 drives or stops the upstream pump 21. Upon receipt of the signal transmitted based on the displacement of the detection lever 127 of the downstream damper 24, the controller 55 drives or stops the downstream pump 22. With such an arrangement, the upstream pump 21 and the downstream pump 22 are actuated in accordance with the amount of the ink stored in the upstream damper 23 and the downstream damper 24. In this manner, a predetermined amount of ink is kept in the ink storage chamber 123. Therefore, the ink is supplied to the ink head 11 stably and reliably.

In this preferred embodiment, the upstream damper 23 and the downstream damper 24 each include the ink storage chamber 123 to store the ink, the damper film 122, and the spring 124. The damper film 122 is provided over the ink storage chamber 123, and is deformable inward or outward with respect to the ink storage chamber 123 based on the amount of the ink stored in the ink storage chamber 123. The spring 124 is located in the ink storage chamber 123, and provides the damper film 122 with an elastic force. In this preferred embodiment, the upstream damper 23 and the downstream damper 24 are mounted on the carriage 4 together with the ink head 11, and are movable in the left-right direction. While the upstream damper 23 and the downstream damper 24 move in the left-right direction, the pressure applied to the ink flow channel 20 in the ink supply system 10 may fluctuate. In this example, the fluctuation in the pressure is easily absorbed by the spring 124 included in each of the upstream damper 23 and the downstream damper 24. The pulsation of each of the upstream damper 23 and the downstream damper 24 is easily absorbed by the spring 124 included in each of the upstream damper 23 and the downstream damper 24, respectively.

In this preferred embodiment, as shown in FIG. 7, in the printing wait state, the printing wait control processor 73 executes control such that the inlet valve 26 and the outlet valve 27 are closed, and the upstream pump 21 and the downstream pump 22 are stopped. As a result, in the printing wait state, since the upstream pump 21 and the downstream pump 22 are stopped, the ink is prevented from flowing into the ink head 11, and the ink is prevented from leaking from the ink head 11. In the printing wait state, the ink in the ink tank 12 is prevented from flowing into the connection flow channel 14.

In this preferred embodiment, as shown in FIG. 8, in the air discharge state, the air discharge control processor 74 executes control such that the inlet valve 26 and the outlet valve 27 are opened, and the upstream pump 21 and the downstream pump 22 are stopped. The air discharge control processor 74 executes control such that the outlet pump 28 is driven, and the discharge mechanism 34 of the air trap 25 is driven. As a result, the air stored in the ink pouch 33 of the air trap 25 is discharged into the exhaust liquid tank 29 via the outlet flow channel 17. In this preferred embodiment, in the air discharge state, the upstream pump 21 and the downstream pump 22 are stopped. Therefore, the air stored in the ink pouch 33 is prevented from flowing into the upstream flow channel 15 or the downstream flow channel 16. Thus, the air-containing ink is prevented from being ejected from the ink head 11 in the printing state.

In this preferred embodiment, as shown in FIG. 9, in the purge state, the purge control processor 75 executes control such that the inlet valve 26 is opened, and the outlet valve 27 is closed. The purge control processor 75 executes control such that the upstream pump 21 is driven, and the downstream pump 22 is stopped. As a result, in the purge state, the ink is ejected from the ink head 11. At the same time as the ejection of the ink, the ink in the ink tank 12 is supplied to the ink head 11 via the upstream flow channel 15. In this manner, when the ejection fault occurs, the purse state is realized to solve the ejection fault.

In this preferred embodiment, as shown in FIG. 10, in the first filling control in the ink filling state, the first ink filling control processor 81 executes control such that the inlet valve 26 is opened, and the outlet valve 27 is closed. The first ink filling control processor 81 executes control such that the upstream pump 21 is driven, the downstream pump 22 is stopped, and the discharge mechanism 34 of the air trap 25 is stopped. As a result, in the first filling control, the connection flow channel 14 and the upstream flow channel 15 are filled with the ink. As shown in FIG. 11, in the second filling control in the ink filling state, after the first ink filling control processor 81 executes the control, the second ink filling control processor 82 controls the upstream pump 21 to stop. As a result, in the second filling control, the ink pouch 33 of the air trap 25 is filled with the ink with no ink flowing into the upstream flow channel 15 or the downstream flow channel 16.

As shown in FIG. 12, in the third filling control in the ink filling state, after the second ink filling control processor 82 executes the control, the third ink filling control processor executes control such that the upstream pump 21 and the downstream pump 22 are driven. As a result, in the third filling control, the ink in the ink tank 12 flows into the downstream flow channel 16 via the connection flow channel 14 and the upstream flow channel 15. Thus, the downstream flow channel 16 is filled with the ink. As shown in FIG. 13, in the fourth filling control in the ink filling state, after the third ink filling control processor 83 executes the control, the fourth ink filling control processor 84 executes control such that the outlet valve 27 is opened, and the upstream pump 21 and the downstream pump 22 are stopped. The fourth ink filling control processor 84 executes control such that the discharge mechanism 34 of the air trap 25 is driven, and the outlet pump 28 is driven. As a result of the first through third filling control, the air in the ink flow channel 20 is stored in the ink pouch 33 of the air trap 25. Therefore, in the fourth filling control, the air stored in the ink pouch 33 of the air trap 25 is discharged into the exhaust liquid tank 29 via the outlet flow channel 17 together with the ink. Therefore, as a result of the first through fourth filling control, the ink flow channel 20 with no ink is filled with the ink, and the air in the ink flow channel 20 is removed.

In this preferred embodiment, as shown in FIG. 15, in the first discharge control in the ink discharge state, the first ink discharge control processor 85 executes control in the state where the ink tank 12 is detached from the inlet flow channel 13, such that the inlet valve 26 and the outlet valve 27 are opened. The first ink discharge control processor 85 executes control such that the upstream pump 21 and the downstream pump 22 are stopped, and the outlet pump 28 is driven. As a result, in the first discharge control, the ink in the inlet flow channel 13 flows into the connection flow channel 14, and the inlet flow channel 13 is put into a state containing no ink. As shown in FIG. 16, in the second discharge control in the ink discharge state, after the first ink discharge control processor 85 executes the control, the second ink discharge control processor 86 executes control such that the inlet valve 26 is closed, and the upstream pump 21 and the downstream pump 22 are driven. As a result, in the second discharge control, the ink in the outlet flow channel 17 is discharged into the exhaust liquid tank 29. The ink in the connection flow channel 14 is discharged into the exhaust liquid tank 29 via the outlet flow channel 17. The ink in the downstream flow channel 16 is discharged into the exhaust liquid tank 29 via the connection flow channel 14 and the outlet flow channel 17. The ink in the upstream flow channel 15 is discharged into the exhaust liquid tank 29 via the downstream flow channel 16, the connection flow channel 14 and the outlet flow channel 17. Therefore, as a result of the first discharge control and the second discharge control, the ink in the ink flow channel 20 is discharged, and the ink flow channel 20 is put into a state containing no ink.

In this preferred embodiment, as shown in FIG. 1, the upstream damper 23 and the downstream damper 24 are provided in the ink head 11. In this example, the ink head 11, the upstream damper 23 and the downstream damper 24 are mounted on the carriage 4. With such an arrangement, the upstream damper 23 and the downstream damper 24 are located in a space above the ink head 11. In this example, while the carriage 4 moves in the left-right direction at the time of printing, the ink head 11, the upstream damper 23 and the downstream damper 24 move in the left-right direction. Therefore, the relative positions of the ink head 11, the upstream damper 23 and the downstream damper 24 do not change during the printing. Thus, the ink is easily ejected from the ink head 11 stably.

The components of the controller 55, namely, the storage processor 71, the printing control processor 72, the printing wait control processor 73, the air discharge control processor 74, the purge control processor 75, the first ink filling control processor 81, the second ink filling control processor 82, the third ink filling control processor 83, the fourth ink filling control processor 84, the first ink discharge control processor 85 and the second ink discharge control processor 86 may be provided as software. Namely, the above-described components may be realized by the computer by a computer program being executed by the computer. The present invention encompasses a computer program for printing that causes a computer to act as the above-described components. The present invention encompasses a computer-readable storage medium having the computer program stored thereon. The above-described components may be processors realized by execution of the computer program stored on the controller 55. In this case, each of the components may be realized by one processor or a plurality of processors. The present invention encompasses a circuit realizing substantially the same functions as that of the program executed by the components.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink supply system, comprising:
an ink tank to store ink;
an ink head to eject the ink toward a recording medium;
an inlet flow channel including an end connected with the ink tank;
an upstream flow channel connected with the ink head to allow the ink to flow into the ink head;
a connection flow channel that connects the inlet flow channel and the upstream flow channel to each other;
a downstream flow channel including a first end connected with the ink head and a second end connected with the connection flow channel;
an upstream pump provided in the upstream flow channel to supply the ink to the ink head;
a downstream pump provided in the downstream flow channel to allow the ink in the ink head to flow out;
an upstream damper provided in the upstream flow channel at a position closer to the ink head than the upstream pump;
a downstream damper provided in the downstream flow channel at a position closer to the ink head than the downstream pump;
an air trap provided in the connection flow channel, the air trap including an air storage portion to store air in the ink and a discharge mechanism to discharge the air stored in the air storage portion to an exhaust liquid tank; and
a controller to control the upstream pump and the downstream pump; wherein
the upstream damper and the downstream damper each include:
an ink storage chamber to store the ink;
a damper film provided on the ink storage chamber so as to be deformable inward and outward with respect to the ink storage chamber based on an amount of the ink stored in the ink storage chamber; and
a spring located in the ink storage chamber to provide the damper film with an elastic force.

2. An inkjet printer, comprising:
an ink supply system according to claim 1; and
a platen on which a recording medium is to be placed.

3. The inkjet printer according to claim 2, further comprising:
a guide rail extending in a predetermined direction; and
a carriage engaged with the guide rail and including the ink head, the upstream damper and the downstream damper mounted thereon.

4. An ink supply system, comprising:
an ink tank to store ink;
an ink head to eject the ink toward a recording medium;
an inlet flow channel including an end connected with the ink tank;
an inlet valve provided in the inlet flow channel and being o enable and closable;
an upstream flow channel connected with the ink head to allow the ink to flow into the ink head;
a connection flow channel that connects the inlet flow channel and the upstream flow channel to each other;
a downstream flow channel including a first end connected with the ink head and a second end connected with the connection flow channel;

an upstream pump provided in the upstream flow channel to supply the ink to the ink head;

a downstream pump provided in the downstream flow channel to allow the ink in the ink head to flow out;

an upstream damper provided in the upstream flow channel at a position closer to the ink head than the upstream pump;

a downstream damper provided in the downstream flow channel at a position closer to the ink head than the downstream pump;

an outlet flow channel including a first end connected with the connection flow channel and a second end connected with the exhaust liquid tank; and an outlet valve provided in the outlet flow channel and being openable and closable a controller to control the upstream pump and the downstream pump; wherein the upstream damper and the downstream damper each includes:

an ink storage chamber to store the ink;

a damper film provided on the ink storage chamber so as to be deformable inward and outward with respect to the ink storage chamber based on an amount of the ink stored in the ink storage chamber; and a spring located in the ink storage chamber to provide the damper film with an elastic force; and the controller includes a printing control processor to execute control in a printing state such that the inlet valve is opened and the upstream pump and the downstream pump are driven.

5. The ink supply system according to claim 4, wherein the controller includes a printing wait control processor to execute control in a printing wait state such that the inlet valve and the outlet valve are closed and the upstream pump and the downstream pump are stopped.

6. The ink supply system according to claim 4, wherein the controller includes a purge control processor to execute control such that the inlet valve is opened, the outlet valve is closed, the upstream pump is driven, and the downstream pump is stopped or supplies the ink at a decreased flow rate.

7. The ink supply system according to claim 4, further comprising an outlet pump provided in the outlet flow channel at a position closer to the exhaust liquid tank than the outlet valve.

8. The ink supply system according to claim 7, wherein the controller includes:

a first ink discharge control processor to execute control in a state where the ink tank is detached from the inlet flow channel, such that the inlet valve and the outlet valve are opened, the upstream pump and the downstream pump are stopped, and the outlet pump is driven; and a second ink discharge control processor to execute control after the first ink discharge control processor executes the control, such that the inlet valve is closed, and the upstream pump and the downstream pump are driven.

9. The ink supply system according to claim 7, further comprising an air trap provided in the connection flow channel, the air trap including:

an air storage portion to store air in the ink; and a discharge mechanism to discharge the air stored in the air storage portion to an exhaust liquid tank; wherein the controller includes an air discharge control processor to execute control such that the outlet valve is opened, the upstream pump and the downstream pump are stopped, the outlet pump is driven, and the discharge mechanism of the air trap is driven.

10. The ink supply system according to claim 7, further comprising an air trap provided in the connection flow channel, the air trap including:

an air storage portion to store air in the ink; and a discharge mechanism to discharge the air stored in the air storage portion to an exhaust liquid tank; wherein the controller includes:

a first ink filling control processor to execute control such that the inlet valve is opened, the outlet valve is closed, the upstream pump is driven, the downstream pump is stopped, and the discharge mechanism of the air trap is stopped;

a second ink filling control processor to execute control after the first ink filling control processor executes the control, such that the upstream pump is stopped;

a third ink filling control processor to execute control after the second ink filling control processor executes the control, such that the upstream pump and the downstream pump are driven; and a fourth ink filling control processor to execute control after the third ink filling control processor executes the control, such that the outlet valve is opened, the upstream pump and the downstream pump are stopped, the discharge mechanism of the air trap is driven, and the outlet pump is driven.

* * * * *